US005443259A

United States Patent [19]

Segan et al.

[11] Patent Number: 5,443,259

[45] Date of Patent: Aug. 22, 1995

[54] GAME APPARATUS INCLUDING BASKETBALL, PINBALL, AND TARGET BOWLING

[75] Inventors: Marc H. Segan, New York; Gary Strauss, Mamaroneck, both of N.Y.; Gerald W. Cummings, Marlton, N.J.

[73] Assignee: M. H. Segan Limited Partnership, Great Barrington, Mass.

[21] Appl. No.: 273,426

[22] Filed: Jul. 11, 1994

Related U.S. Application Data

[63] Continuation-in-part of Ser. No. 194,443, Feb. 10, 1994, abandoned.

[51] Int. Cl.[6] ..... A63B 63/08; A63F 7/02

[52] U.S. Cl. ..... 273/1.5 R; 273/123 A; 273/352; 273/401

[58] Field of Search ..... 273/1.5 R, 1.5 A, 352, 273/401, 119 R, 119 A, 119 B, 120 A, 121 A, 122 A, 123 A, 124 A, 125 A, 118 A

[56] References Cited

U.S. PATENT DOCUMENTS

| | | | |
|---|---|---|---|
| 2,010,213 | 8/1935 | Bergoffen | 273/352 |
| 2,926,915 | 3/1960 | Johns | 273/352 |
| 3,092,387 | 6/1963 | Wagner | 273/352 X |
| 3,362,712 | 1/1968 | Wagner | 273/374 |
| 4,013,292 | 3/1977 | Cohen et al. | 273/1.5 R |
| 4,054,287 | 10/1977 | Goldfarb et al. | 273/119 R |
| 4,223,889 | 9/1980 | Konta | 273/127 R |
| 4,291,885 | 9/1981 | Cohen | 273/347 |
| 4,354,680 | 10/1982 | Kmiec | 273/121 A |
| 4,647,043 | 3/1987 | Wiczer | 273/121 R |
| 4,735,392 | 4/1988 | Farmer | 248/439 |
| 4,786,371 | 11/1988 | Postol | 273/1.5 A |
| 4,805,917 | 2/1989 | Cochran et al. | 273/397 |
| 4,838,549 | 6/1989 | Woodall | 273/1.5 A |
| 4,840,375 | 6/1989 | Lawlor et al. | 273/121 A |
| 4,852,837 | 8/1989 | Merten et al. | 248/188 |
| 5,016,875 | 5/1991 | Joseph | 273/1.5 R |
| 5,129,648 | 7/1992 | Sweeney et al. | 273/1.5 A |
| 5,133,546 | 7/1992 | Matherne et al. | 273/1.5 A |

OTHER PUBLICATIONS

Back To Basics Toys, Games and Hobbies, Holiday 1994—Spring 1995, "6-In-1 Game Table"p. 54.

Regent, The Name Is Games, Basketballs and Accessories, p. 39 No Date.

SKEE-BALL, Inc., SKEE-BALL, The Game They Keep Coming Back To, 1991 brochure.

*Primary Examiner*—William H. Grieb

*Attorney, Agent, or Firm*—Howrey & Simon; C. Scott Talbot; Leo J. Jennings

[57] ABSTRACT

A game apparatus combines pinball, target bowling and basketball games in a single combined assembly, with a common scorekeeping and control system. The game apparatus includes a basketball rim and backboard support post that rotates between an upright, play position and an inverted, stowed position.

33 Claims, 36 Drawing Sheets

VCC
C4
0.1U
17
R30
100K
R31
100K
C2
15P
R1
1M
C1
15P
CER.RES.
X1
5.00MHZ
12
11
XTAL1
XTAL2
620
D1
R2
47K
10
RESET
C3
4U7
10V
U1
TMS70CT40
R28
15K
R29
15K
9
8
INT1
INT3
SW10
START TEST
(6)
MC
GND
26
1
D7
D6
D5
D4
C7
C6
C5
C4
C3
C2
C1
C0
B7
B6
B5
B4
A3
A2
A1
A0
R3
2.2K
R4
2.2K
R5
2.2K
R6
2.2K
R7
2.2K
R8
2.2K
R9
2.2K
Q1
Q2
Q3
Q4
Q5
Q6
Q7
R10
47
R11
47
R12
47
R13
47
R14
47
R15
47
R16
47
TO

C5
0.1U
16
U2
74HC138
A
B
C
G1
G2A
G2B
Y0
Y1
Y2
Y3
Y4
Y5
Y6
Y7
R17
15K
R32
10K
Q15
Rrf1
22
CRF1
.01U
CRF2
.01U
(2)
Rrf2
100
ESD (1)
IF NECESSARY FOR RFI
Y6
TO FIG.23D

| FIG.24A |
| --- |
| FIG.24B |

GAME APPARATUS INCLUDING BASKETBALL, PINBALL, AND TARGET BOWLING

This application is a continuation-in-part of U.S. patent application Ser. No. 08/194,443, filed Feb. 10, 1994, now abandoned.

BACKGROUND OF THE INVENTION

The invention relates generally to games and specifically to a game apparatus that combines two or more of a pinball, target bowling and basketball game. More specifically, the invention relates to a game apparatus in which the pinball, target bowling and basketball games are interconnected in a single combined apparatus.

There are a variety of types of conventional game apparatuses known, including pinball games, target bowling games, and basketball games. For example, U.S. Pat. No. 4,354,680 to Kmiec describes a pinball game including a generally horizontal cabinet having a slanted playfield on which a ball rolls. A glass top overlies the playfield. Flippers are actuated by the player, using flipper actuators on the left and right sides of the cabinet, to attempt to prevent the pinball from rolling out of the playfield. A scoring display is provided on the front face of a generally vertical back cabinet extending above the back end of the horizontal cabinet.

Various pinball scoring features are also known. For example, U.S. Pat. No. 4,223,889 to Konta discloses a pinball bumper with a mechanical drive system.

Target bowling games are also known. These games are exemplified by the games sold under the trade mark "SKEE-BALL". As used herein, the term target bowling is intended to refer to any of the games similar to the known "SKEE-BALL" games, and to other target bowling games having characteristics similar to those described below. Examples of target bowling games are shown in U.S. Pat. No. 2,010,213 to Bergoffen and U.S. Pat. No. 2,926,915 to Johns. These target bowling games include an alley or platform with an upwardly curving portion at the back end thereof. When the player rolls a ball down the alley, it is projected by the upward curve towards a scoring area having a plurality of circular scoring areas separated by upstanding wall members. The ball falls into a scoring hole corresponding to the area in which the ball lands. A scoring mechanism registers the score according to what hole the ball falls into and the score is displayed in a score window above the back end of the scoring area.

Basketball games employing a return net to return a thrown basketball to the user and/or which count successfully thrown baskets are also known. For example, U.S. Pat. No. 4,786,371 to Postol shows a basketball retriever apparatus including a net-carrying frame having its upper end hooked onto a lower portion of a basketball backboard and a lower end supported by legs located below and in front of the backboard.

U.S. Pat. No. 4,805,917 to Cochran, et al. discloses a basketball game having rigid upper and lower return boards located below and in front of the basket for returning the ball to the player after a basket. Side netting is supported by a framework to prevent the ball from bouncing out the side.

U.S. Pat. No. 5,133,546 to Matherne, et al. discloses a foldable basketball game apparatus including a framework that supports one or two basketball goals and a ball return. The ball return has side netting and an inclined flexible bottom. A scoring mechanism having an arm that is depressed when a basket is completed, counts completed baskets and also includes a timer for timing the game.

U.S. Pat. No. 3,362,712 to Wagner discloses a basketball game having an inclined ball return, and top and side netting. A ball-retaining ring holds the ball after each completed basket until released by the player.

U.S. Pat. No. 4,054,287 to Goldfarb, et al. discloses a toy amusement arcade that includes a pinball game, a target bowling game and a gun range game. Each game is provided in a completely enclosed housing separate from the other games.

However, in the prior art there are no known games that successfully combine two or three of pinball, target bowling and basketball games in a single apparatus. Although it is often desired to have the capability of playing more than one game for a greater range of play options, the prior art requires the use of two or three separate and independent game apparatuses—that is, a separate and independent apparatus for each game.

The use of two or more separate and independent apparatuses has several disadvantages. The total shipping and manufacturing costs are higher for several separate and independent game apparatuses than for a single, combined apparatus, since many structural parts, such as the support legs and main bodies of each, are duplicated. Electronic parts such as the main power supplies, the power and volume controls, and the scoring displays may also be duplicated. The use of two or more separate and independent apparatuses also takes up additional floor space as compared to a single combined apparatus.

The prior art basketball games having a return net suffer from the additional disadvantage that they are somewhat bulky when not in use. For example, although the game disclosed in U.S. Pat. No. 5,133,546 to Matherne, et al. is foldable, the folding process is cumbersome and the total height of the apparatus is not reduced, because the supports for the rim and backboard do not fold or collapse vertically.

Accordingly, there is a need for an arcade game that combines play features of at least two of pinball, target bowling, and/or basketball games. There is also a need for an assembly that supports a basketball backboard and rim assembly and re-configures conveniently into a compact storage or stowed position having a reduced height.

SUMMARY OF THE INVENTION

The present invention overcomes the need in the prior art for a game that combines play features of at least two of pinball, target bowling and/or basketball games, by providing a game apparatus which combines pinball, target bowling and basketball games in a single assembly. The game apparatus includes a housing having a generally horizontal coffin portion and a back case portion, with a pinball playfield disposed in the coffin portion and a target bowling target disposed in the back case portion. A basketball rim and backboard assembly is coupled to the housing by a backboard support post.

The invention further provides a common scorekeeping and control system for the pinball, target bowling and basketball games, which includes a scoring display, and which communicates with a pinball scoring apparatus, a target bowling scoring apparatus and a basketball scoring apparatus.

The invention still :further provides a basketball game having a rim and backboard support post coupled to the housing that re-configures conveniently into a compact storage or stowed position having a reduced height, by rotating from an upright, play position to an inverted, stowed position. A projection on the housing extends through an aperture in the support post so that the support post is rotatable about the projection.

DETAILED DESCRIPTION

Figure 1:
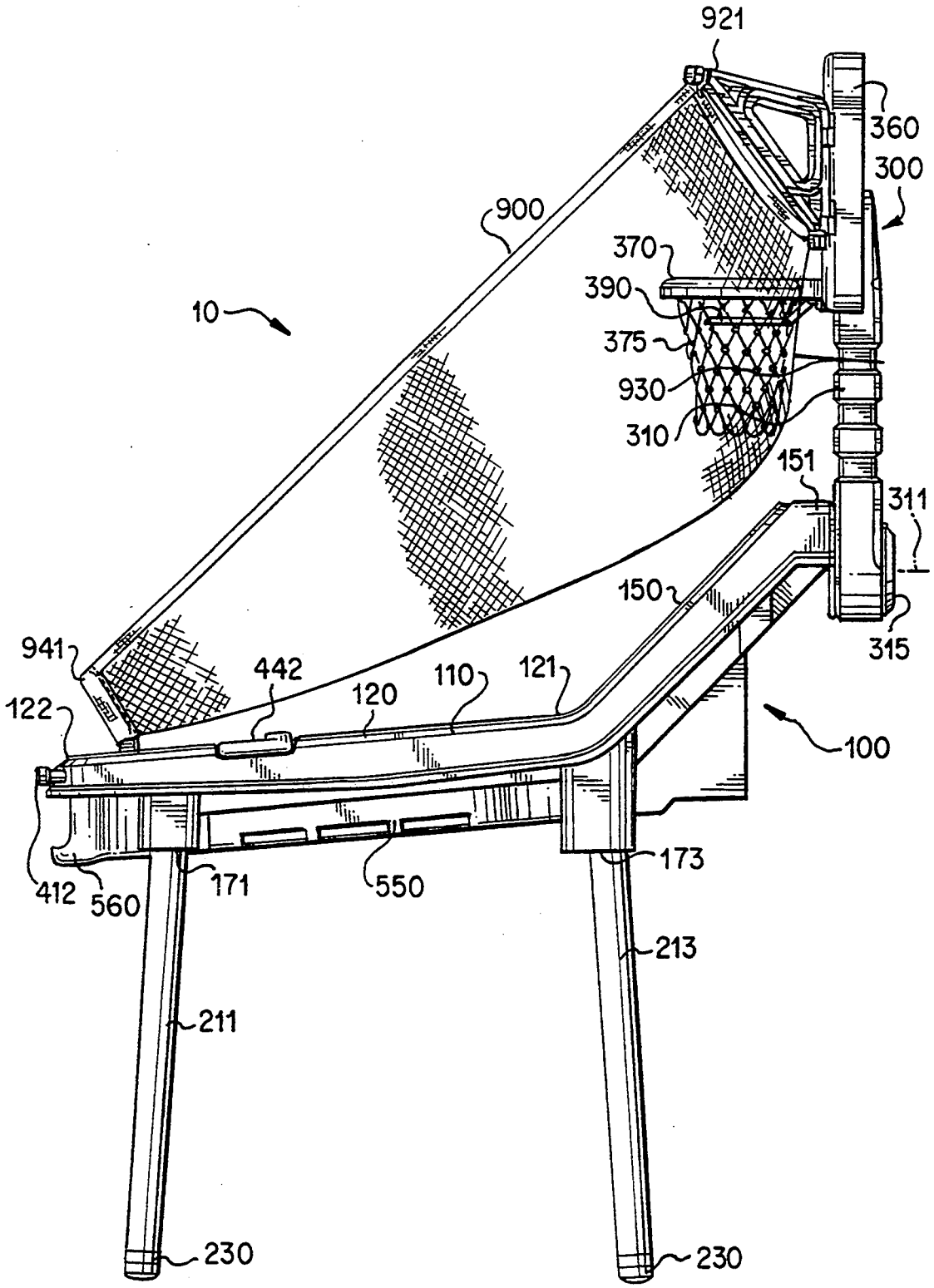
FIG. 1 is a right side elevation of a combination arcade game apparatus embodying the principles of the invention with a backboard support post disposed in a play position and a basketball return net deployed.
Figure 2:
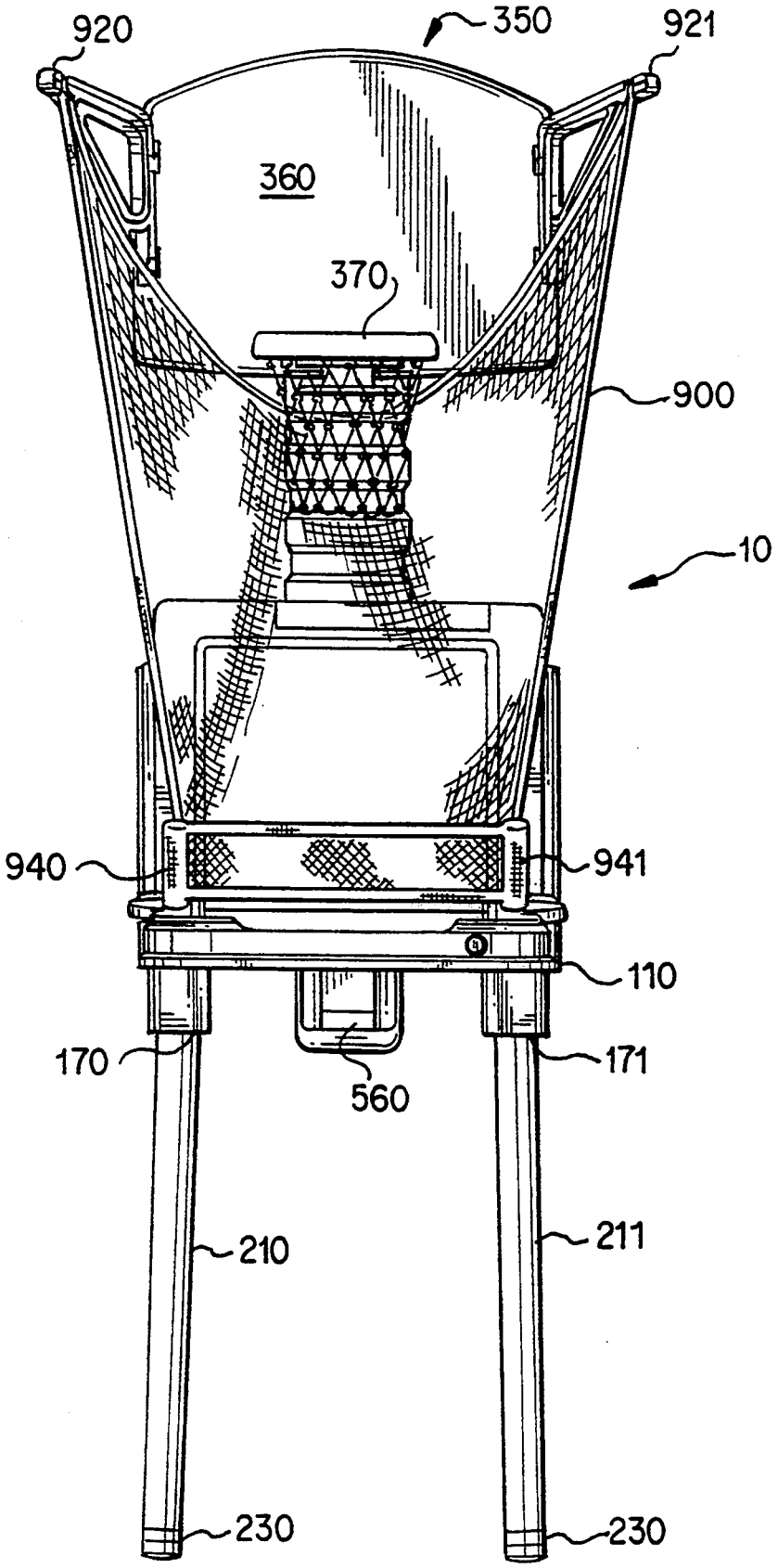
FIG. 2 is a front elevation of the apparatus shown in FIG. 1.
Figure 3:
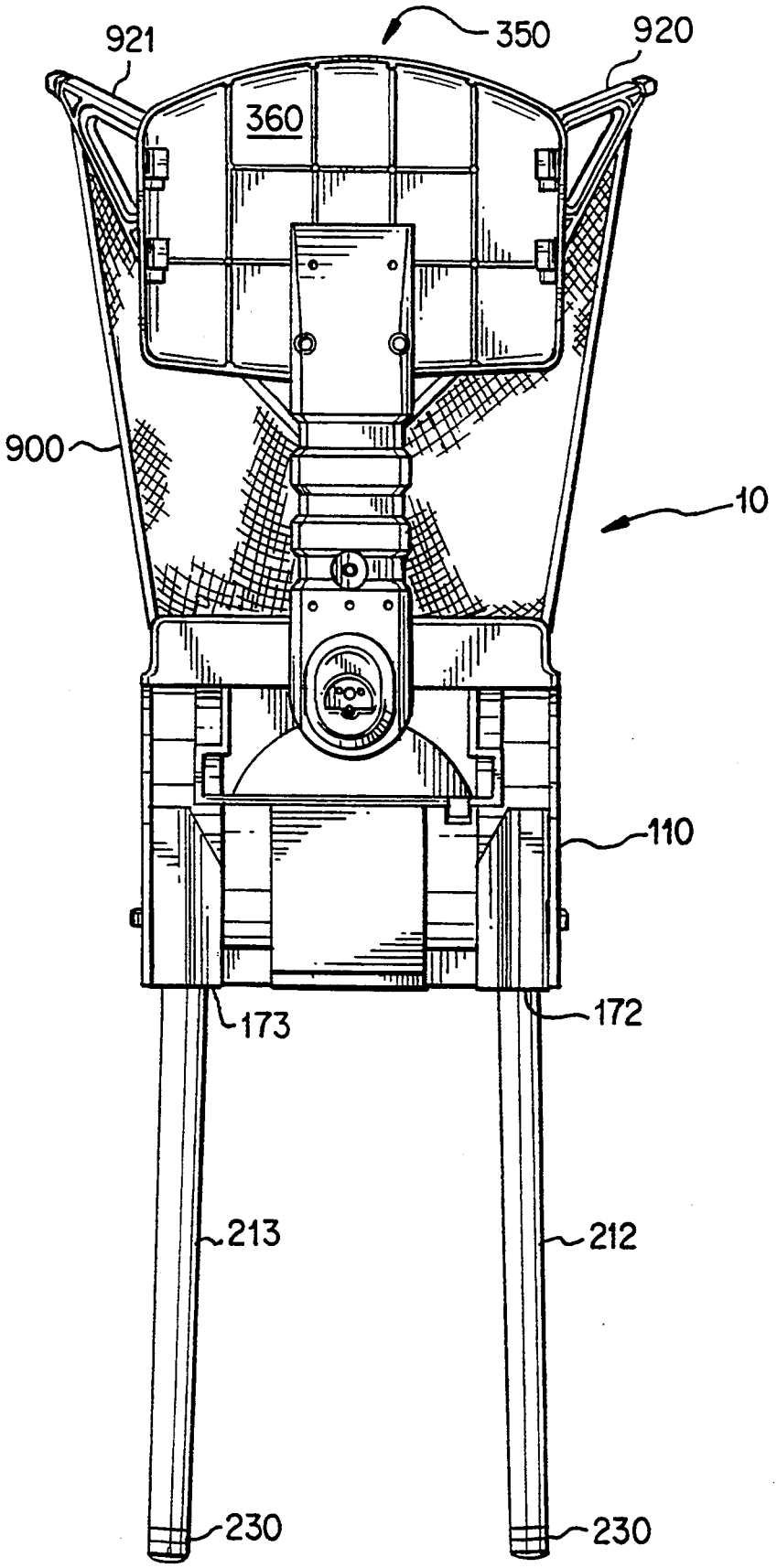
FIG. 3 is a rear elevation of the apparatus shown in FIG. 1.
Figure 4:
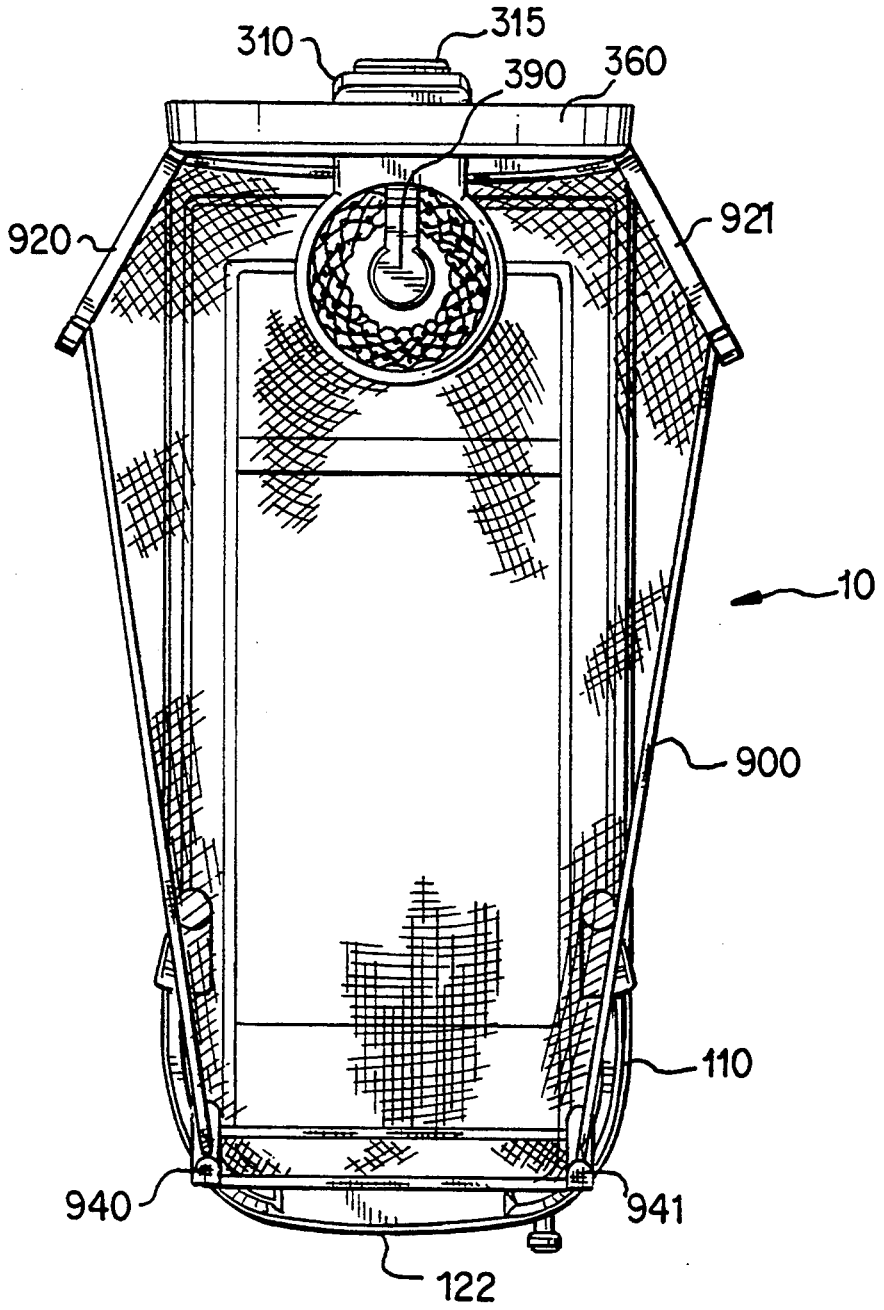
FIG. 4 is a top plan view of the apparatus shown in FIG. 1.
Figure 5:
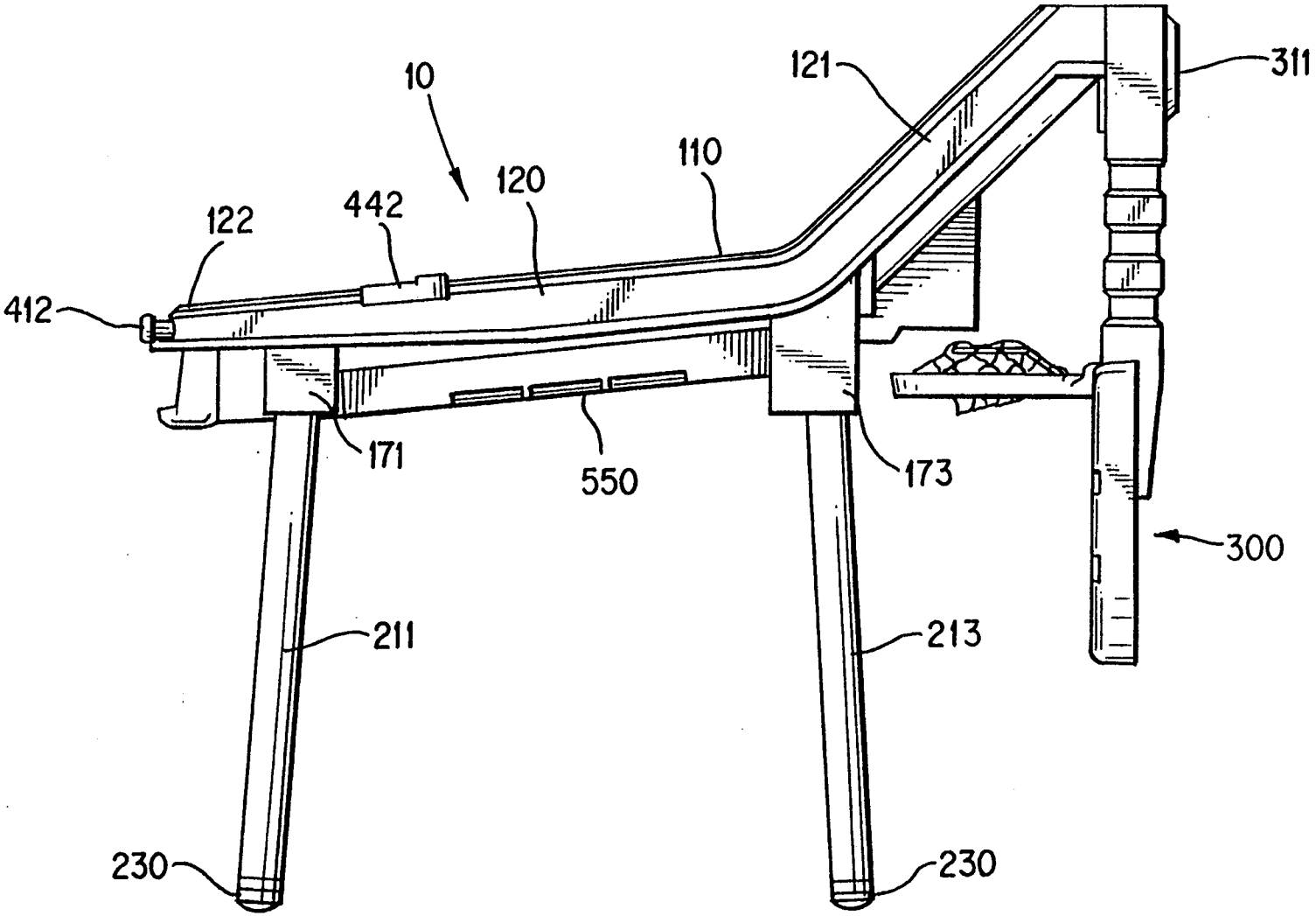
FIG. 5 is a right side elevation of a combination arcade game apparatus embodying the principles of the invention with a backboard support post disposed in a stowed position.

A combination arcade game apparatus 10 embodying the principles of the present invention is illustrated in FIGS. 1 through 12. The game has two main structural assemblies: a main body 100 and a basketball backboard support assembly 300. As described in more detail below, these structural assemblies contain a pinball apparatus 400, a target bowling apparatus 500 including a target 510, and a scoring and control system 600. The pinball and target bowling apparatuses are generally disposed within the main body 100. The scoring and control system 600 is generally disposed in the main body 100 but communicates with a sensor disposed in the backboard support assembly 300, with circuits provided in the pinball apparatus 400, and with sensors disposed in the target bowling apparatus 500.

The body 100 is defined primarily by a housing 110 supported by front supporting legs 210, 211 and rear supporting legs 212, 213. The housing 110 also includes a coffin portion 120 and a back case portion 150. Coffin portion 120 includes a back end 121 where the coffin meets the back case portion 150 and a player end 122 at which the player stands. The back case portion 150 is angled with respect to the coffin portion 120 so that it extends upwardly at an angle greater than the angle of inclination of the coffin portion 120 (approximately 45 degrees from the horizontal plane defined by, for example, the floor or other supporting surface on which the legs 210, 211, 212, 213 rest). The back case 150 has a back end 151 away from the player.

Figure 13A:
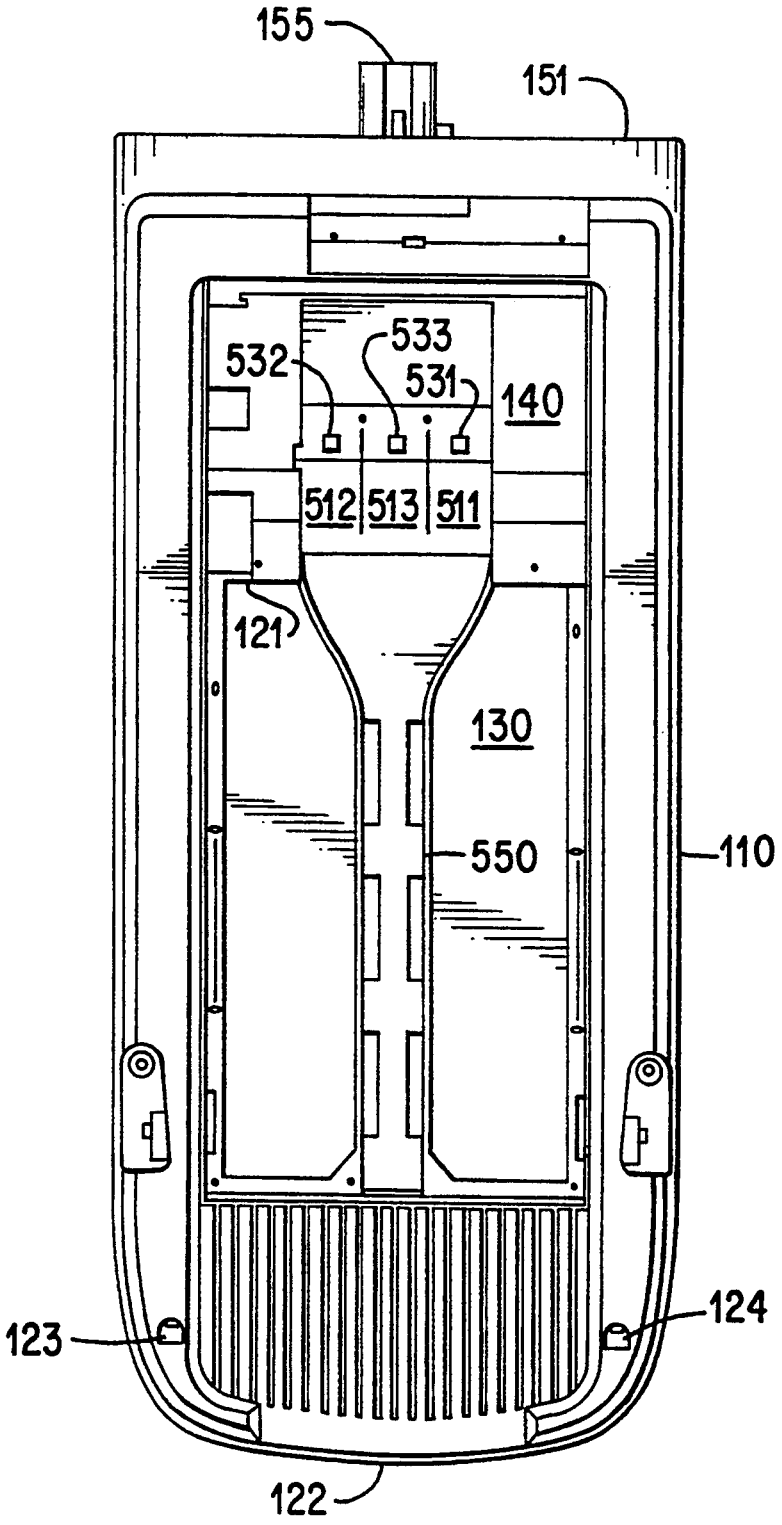
FIGS. 13A, 13B, 13C, and 13F are top plan, bottom plan, side elevation, and partial rear elevation views of the game housing.
Figure 13B:
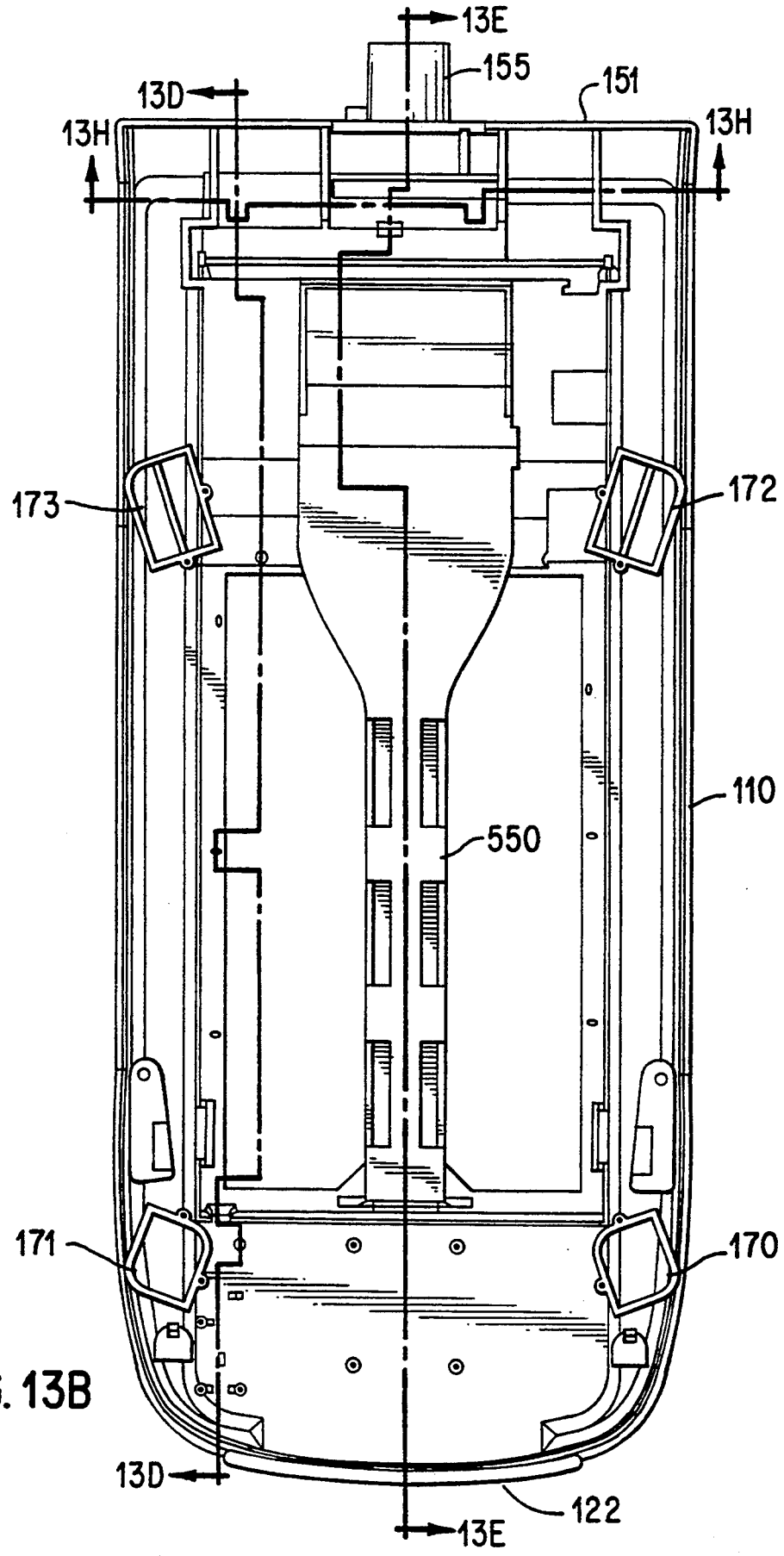
Figure 13C:
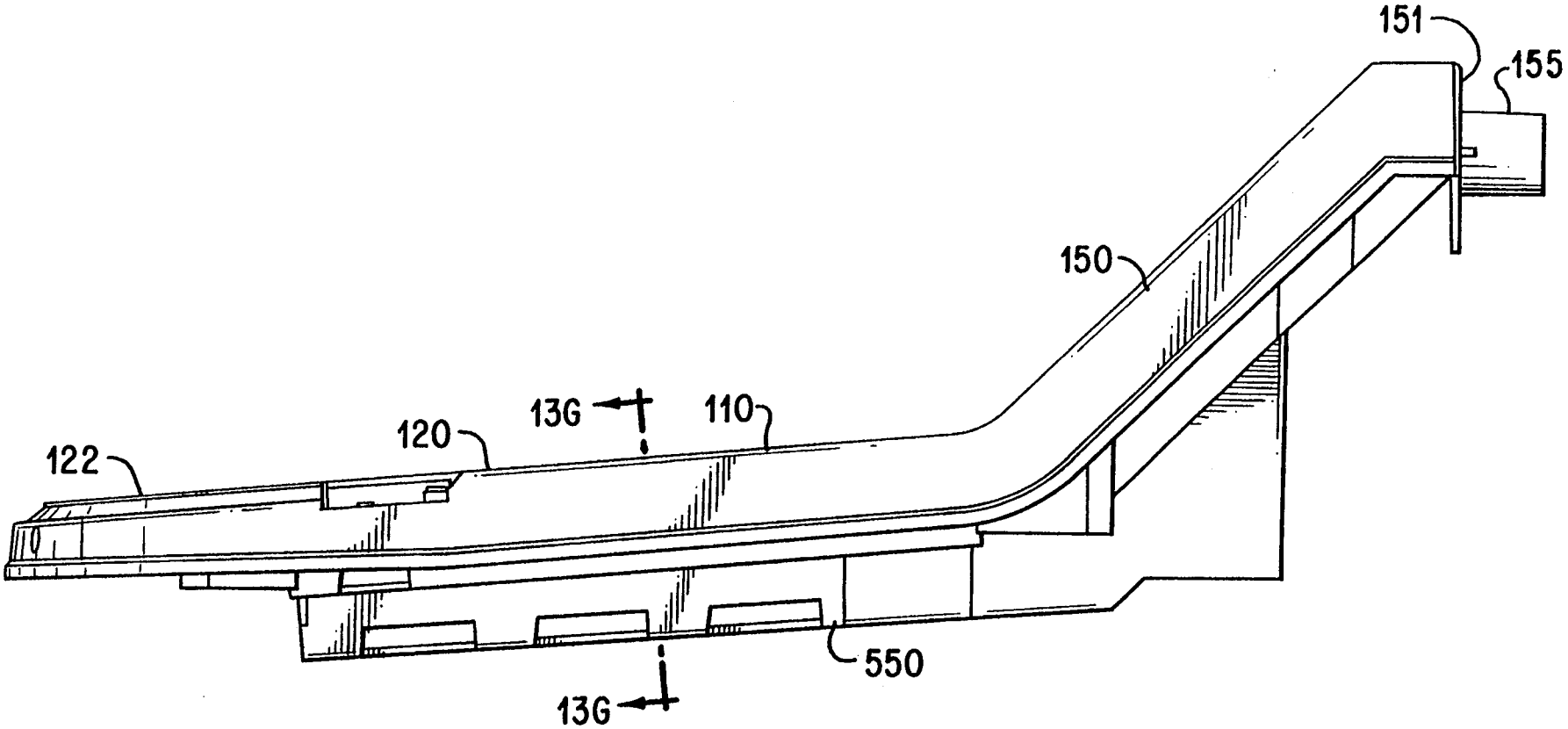
Figure 13D:
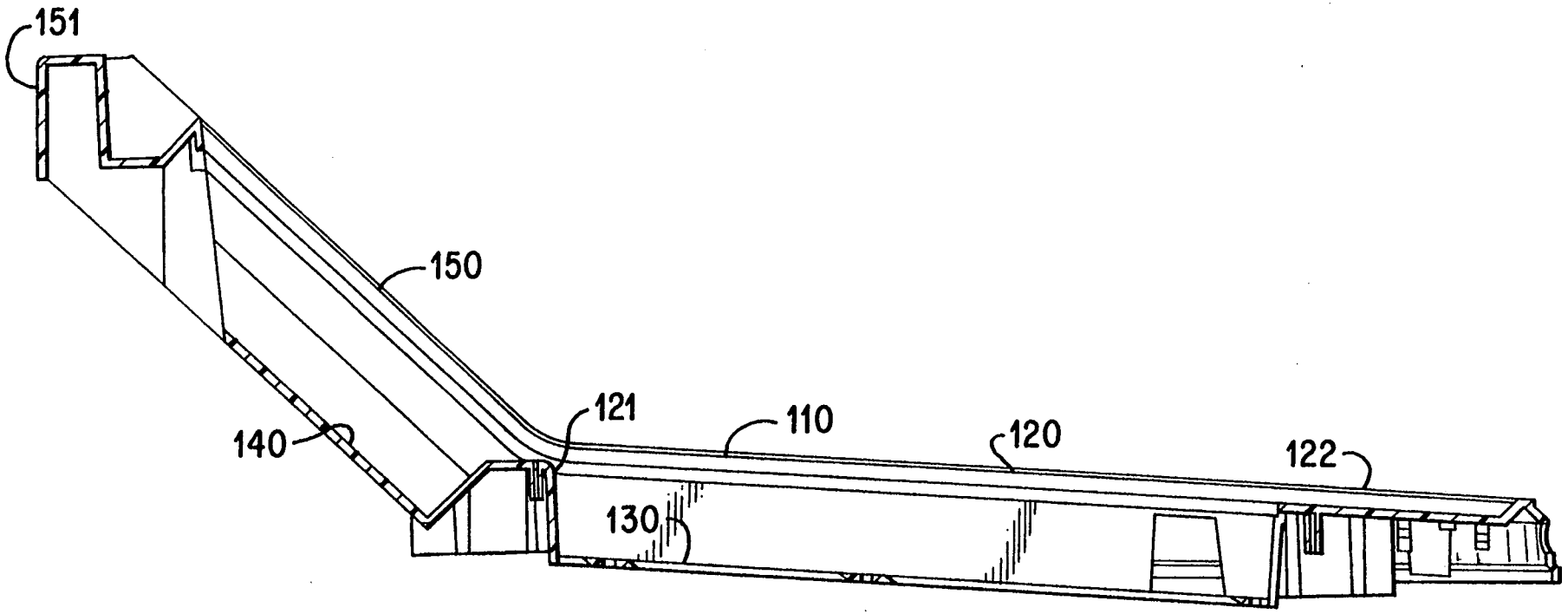
FIGS. 13D, 13E, 13G and 13H are cross sectional views of the game housing taken along the lines 13D in FIG. 13B, 13E in FIG. 13B, 13G in FIG. 13C, and 13H in FIG. 13B, respectively.
Figure 13E:
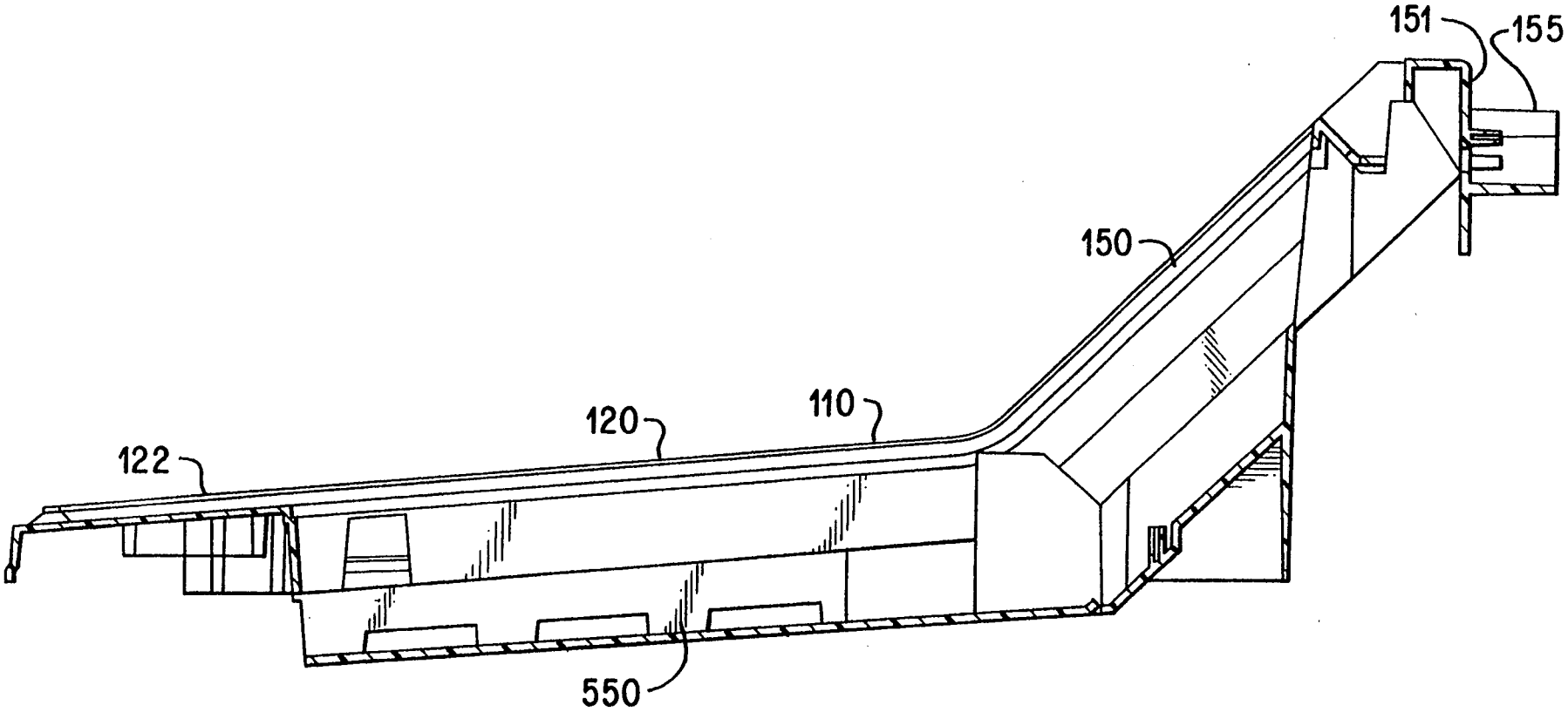
Figure 13F:
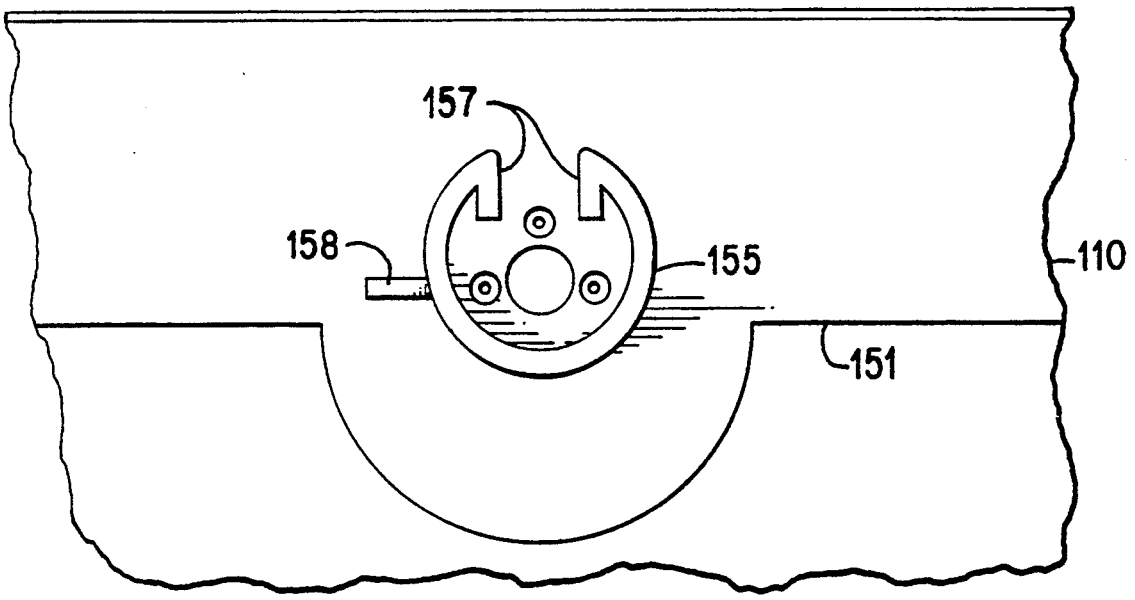
Figure 13G:
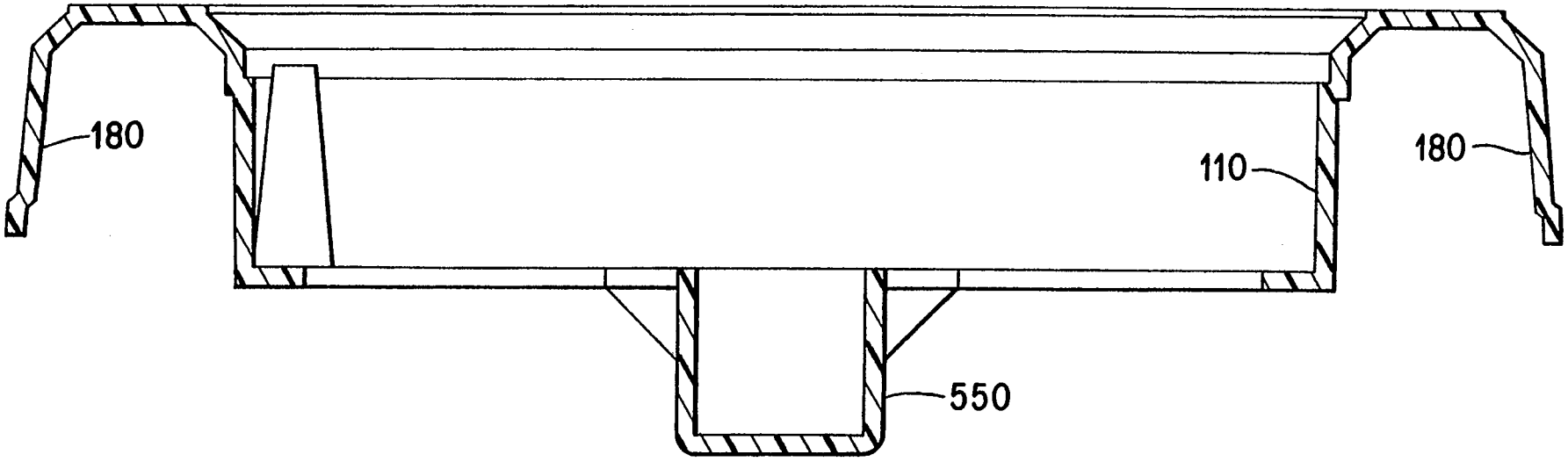
Figure 13H:
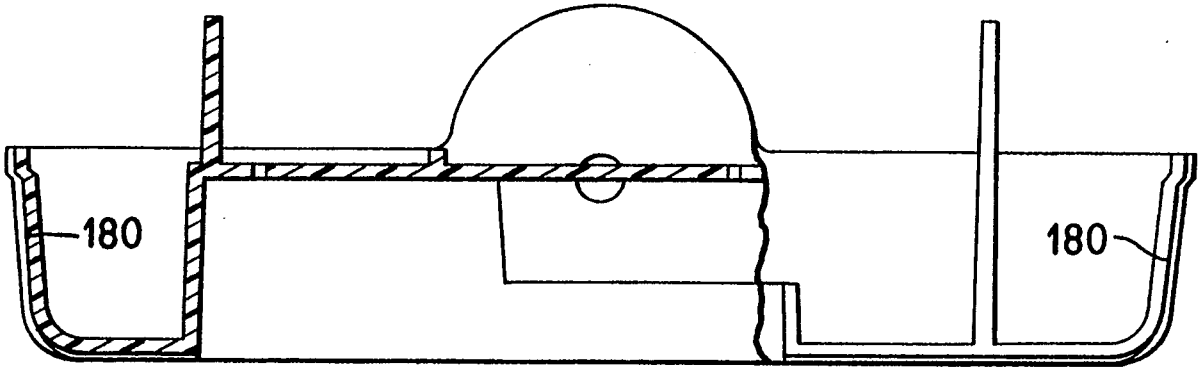

The housing 110 is shown in more detail in FIGS. 13A through 13H. In the illustrated embodiment, the housing 110 is integrally molded of polypropylene structural foam. It is generally defined by a peripheral rail structure 180 that has an inverted U-shape in cross section, as best seen in FIG. 13G. The housing 110 includes a pinball cavity 130 in which to mount the pinball apparatus 400, a target bowling cavity 140 in which to mount the target 510, a target bowling return channel 550, and a projection 155 on which the basketball backboard support assembly 300 is mounted.

It will be appreciated that pinball and target bowling games are especially well suited for combination utilizing a common housing, since both game apparatuses each conventionally include a generally horizontal portion (to provide the playfield in a pinball game or to provide the alley in a target bowling game) and also each conventionally include either a generally upright or an angled back case portion (to provide a scoring display in pinball or to provide a target in target bowling). The present invention utilizes the coffin portion 120 for both the pinball playfield 410 and supporting the target bowling alley defined by large and small panels 710, 720 overlying the playfield 410. The present invention also utilizes the back case 150 for both the scoring and display module 610 and the target bowling target 510. A basketball game with a return net is also well suited for combination with pinball and/or target bowling games, since the housing 110 provides a horizontal distance between the player and the basketball support post 310.

Referring to FIGS. 1 through 12, the supporting legs 210, 211, 212, 213 support the housing 110 so that the coffin portion 120 is approximately horizontal but is angled slightly upwardly from the player end 122 to its back end 121. Although the rear supporting legs 212, 213 are shown being longer than the front supporting legs 210, 211, all four legs may be substantially identical. The legs 210, 211, 212, 213 are independently height-adjustable by means of two-piece, screw-type foot assemblies 230 located at the base of each leg. The feet 230 may be height-adjusted to change the overall angle of the apparatus and to compensate for uneven floor surfaces.

Each supporting leg 210, 211, 212, 213 is attached to the housing 110 by a respective retainer 220, 221, 222, 223 that fits into a respective socket 170, 171, 172, 173 provided in the lower surface of the housing 110, and the retainers 220, 221, 222, 223 are anchored in their respective sockets 170, 171, 172, 173 by means of a screw or other suitable fastener. The supporting legs are secured in the retainers as follows: the supporting legs are tubular and each have a small hole (not visible) near one end that is engaged by a resilient tab (not visible) on the retainer, and when the retainer is inserted into the socket, the tab is held engaged with the supporting leg by contact with the side of the socket, thereby securing the supporting leg in the retainer. This retainer and socket connection is similar to the connection of the removable leg assembly described in U.S. Pat. No. 4,852,837 to Merten, et al., which patent is incorporated herein by reference.

As seen in FIGS. 1 through 4, a pair of front net supports 940, 941 are used together with a pair of rear net supports 920, 921 to support a basketball return net 900 as discussed in more detail later.

Basketball Assembly

As shown in, for example, FIGS. 1 through 12, and FIG. 20, the backboard support assembly 300 includes a support post 310 pivotally mounted to the back end 151 of the back case 150 of the housing 110. A backboard assembly 350 is mounted on the upper end of the support post 310, and includes a backboard 360, a rim 370 and a conventional basketball net 375 mounted on rim 370.

A basketball score paddle 390 is pivotally attached to the backboard 360 and is disposed just below the center of the rim 370. The score paddle 390 is deflected downwardly by the ball as it passes through the rim 370 after a completed basket. When deflected, the score paddle 390 activates a contact-type sensor switch (not visible but disposed in the backboard 360 adjacent the score paddle 390) that communicates with the scoring and control module 600 via a cable 340 that connects between the basketball assembly 300 and the housing 110.

The support post 3 10 is pivotally mounted on the housing 110 for rotation about a horizontal post pivot axis 311. The support post 310 rotates between two opposite vertical positions: the upright, play position illustrated, for example, in FIGS. 1 through 4, and the inverted, stowed position illustrated, for example, in FIGS. 6 through 11.

Figure 20:
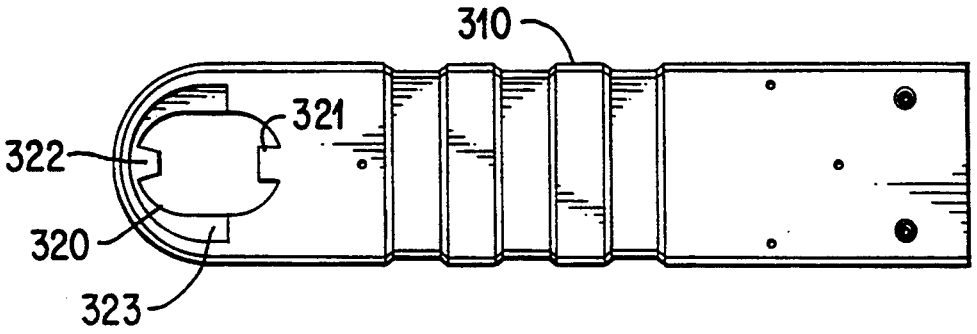
FIG. 20 is an elevation view of the backboard support post.

A projection 155, best shown in FIG. 13F, protrudes from the rear of the back case 150. The projection 155 is generally circular in cross section with a downward vertically-extending slot 157 provided at its top center. The support post 3 10, as shown in FIG. 20, includes an aperture 320 through which the projection 155 passes. The aperture 320 in the support post 310 is generally oval with a pair of opposing upper and lower keys 321, 322 that are each capable of engaging the slot 157 to hold the support post 310 securely in one of the play or stowed positions.

Figure 19B:
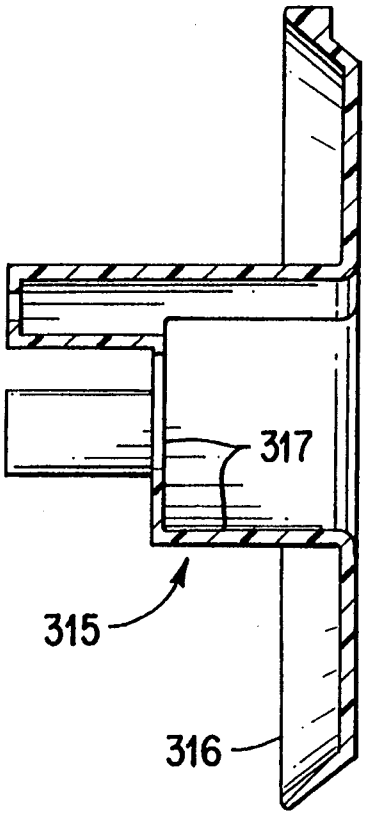
FIG. 19B is a cross sectional view of the rear plate taken along the line 19B in FIG. 19A.
Figure 19A:
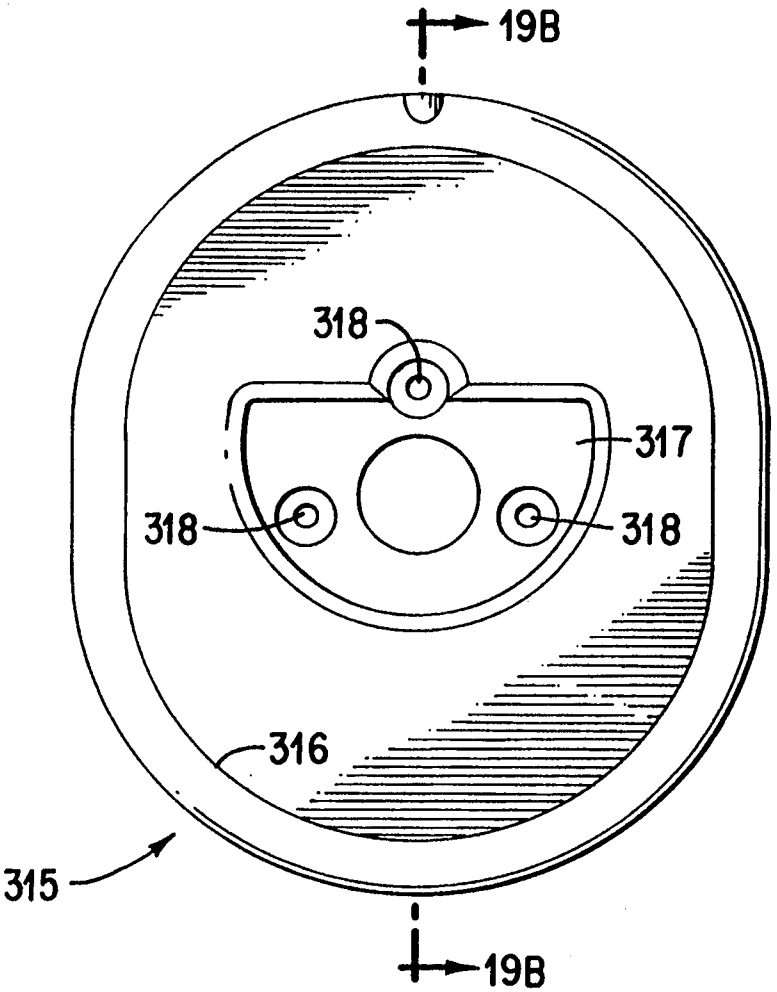
FIG. 19A is an elevation view of a rear plate.

A rear plate 315, illustrated in FIGS. 19A and 19B, is attached to the end of projection 155 and has a flange 316 located adjacent the side of the support post 310 opposite the housing 110 to retain the support post 310 on the projection 155. The rear plate 315 is generally disc-shaped with a central mounting portion 317 that fits snugly into the interior portion of the projection 155, and is attached to projection 155 by screws 318.

Figure 17B:
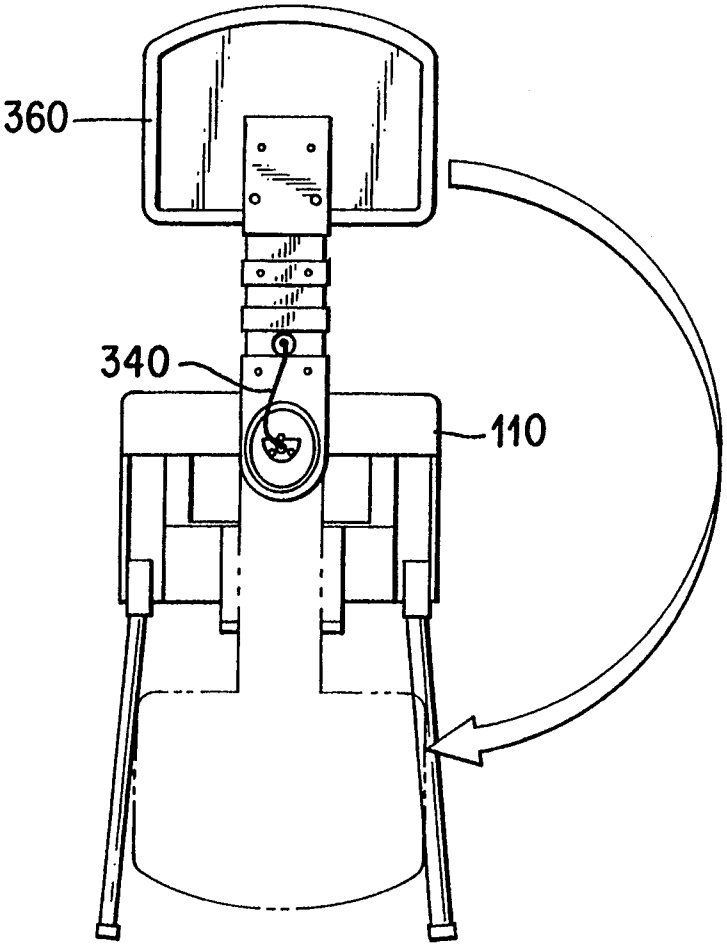
FIGS. 17A and 17B show the rotation of the backboard support post between the stowed position and the play position, respectively.
Figure 17A:
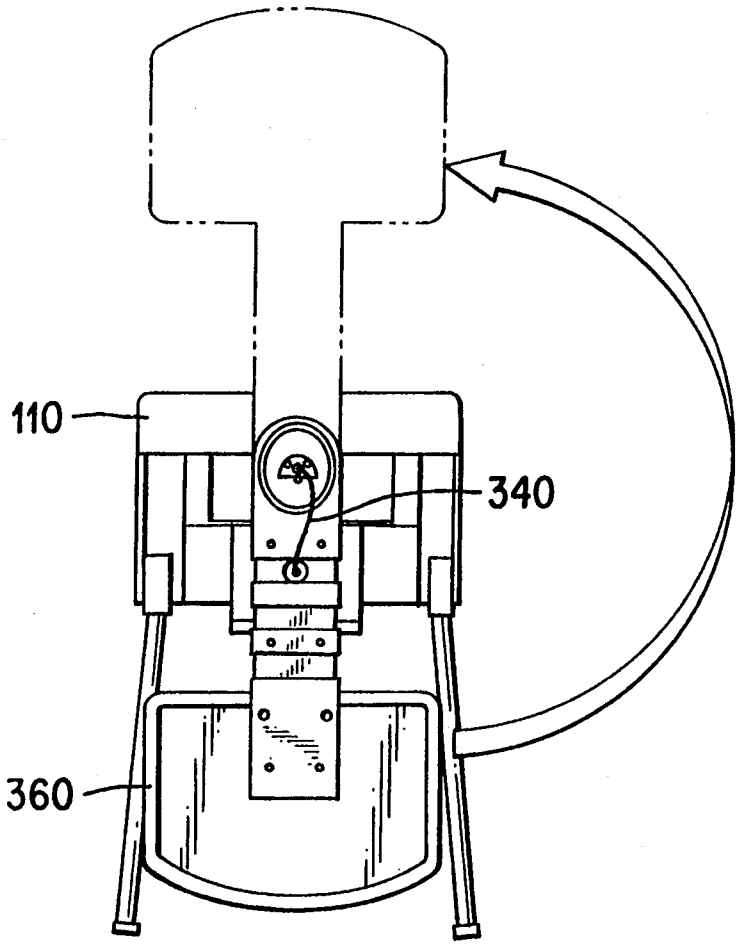
Figure 18A:
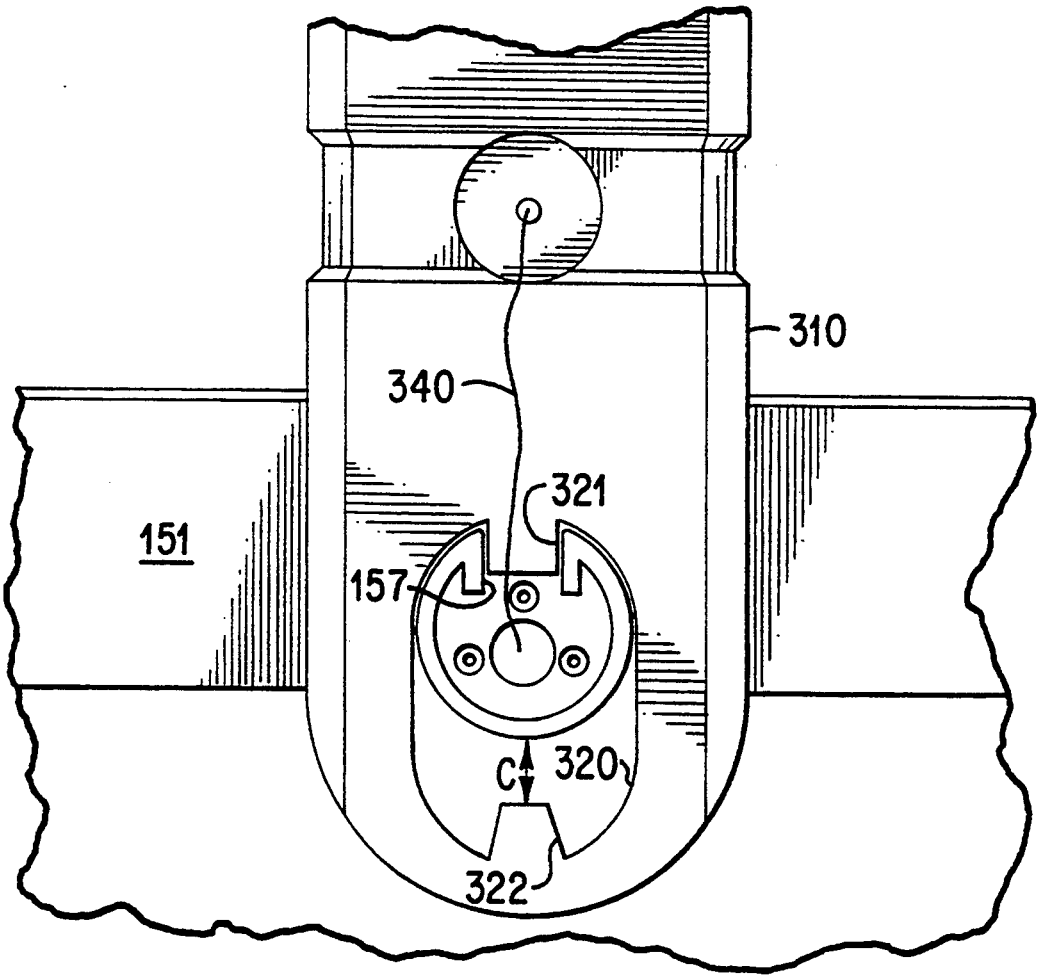
FIGS. 18A, 18B, 18C and 18D are partial rear elevation views showing the connection of the backboard support post to the game housing.
Figure 18B:
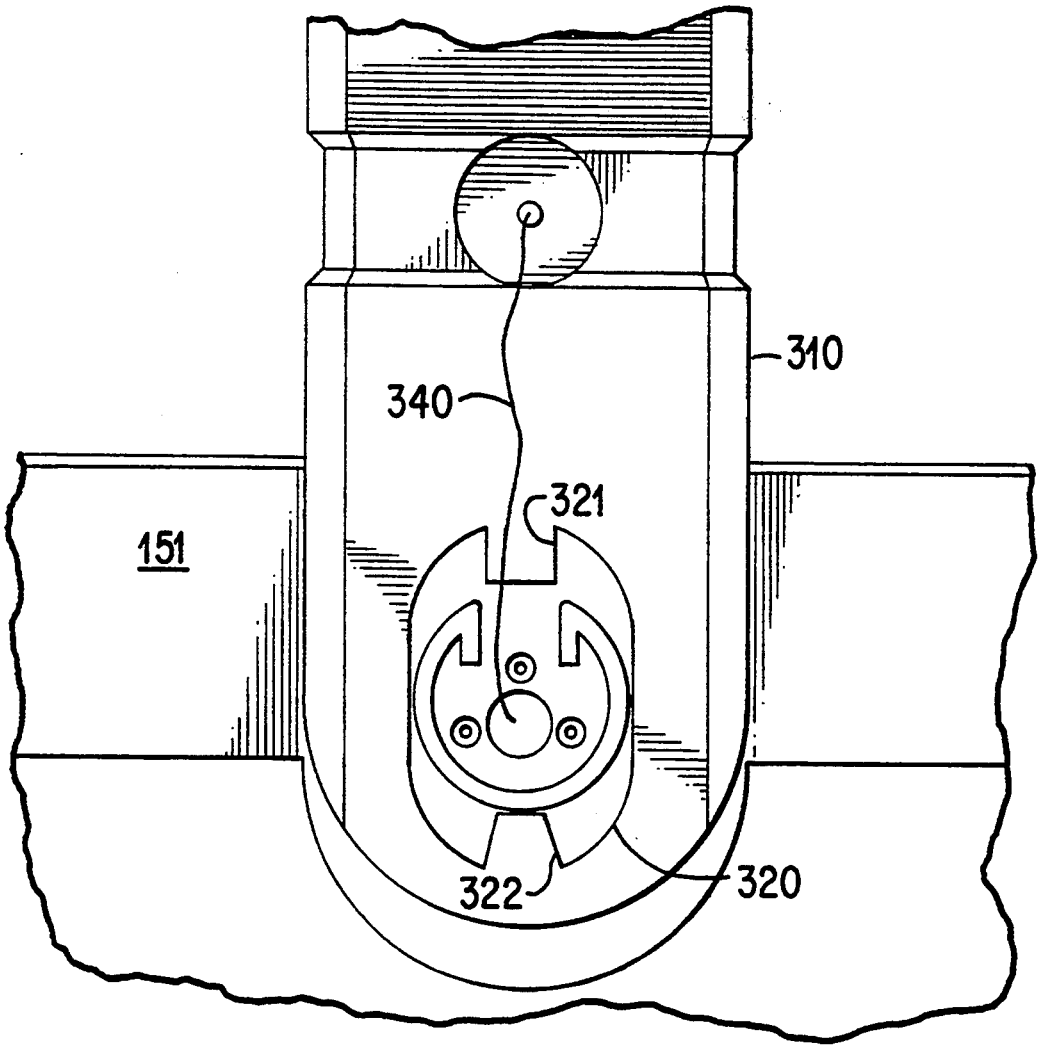
Figure 18C:
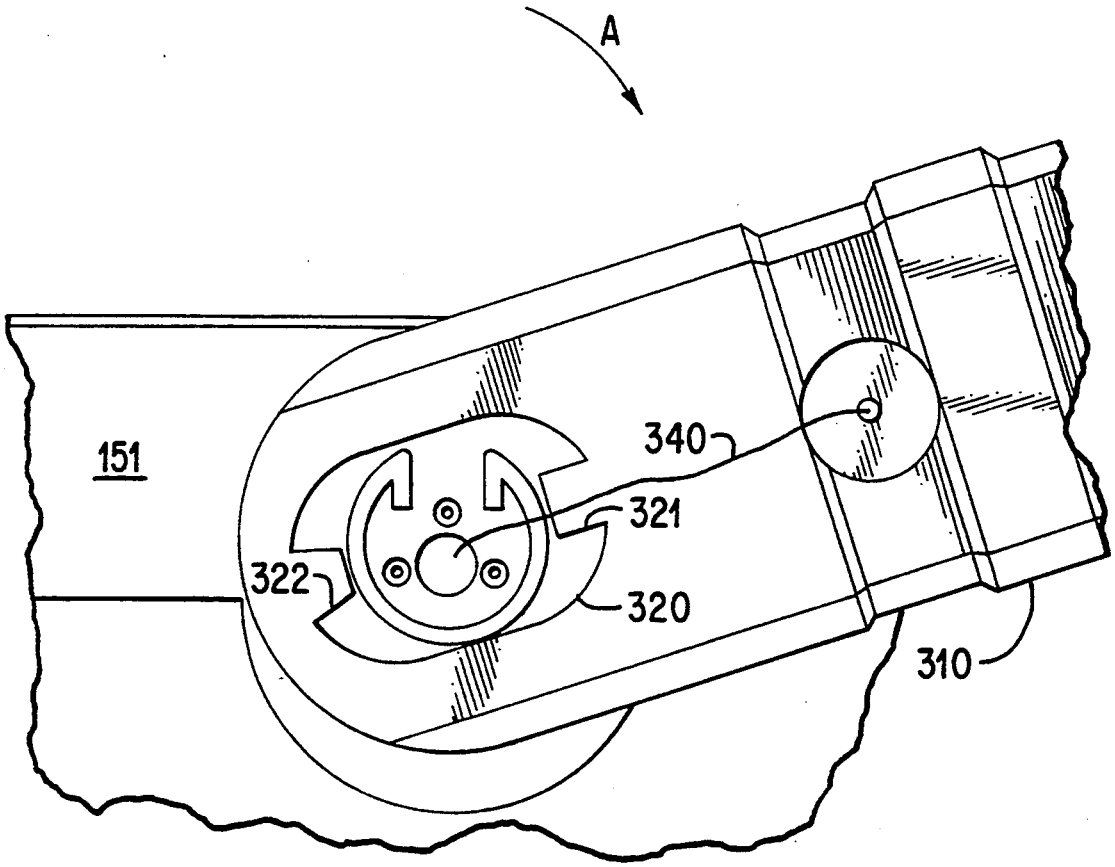
Figure 18D:
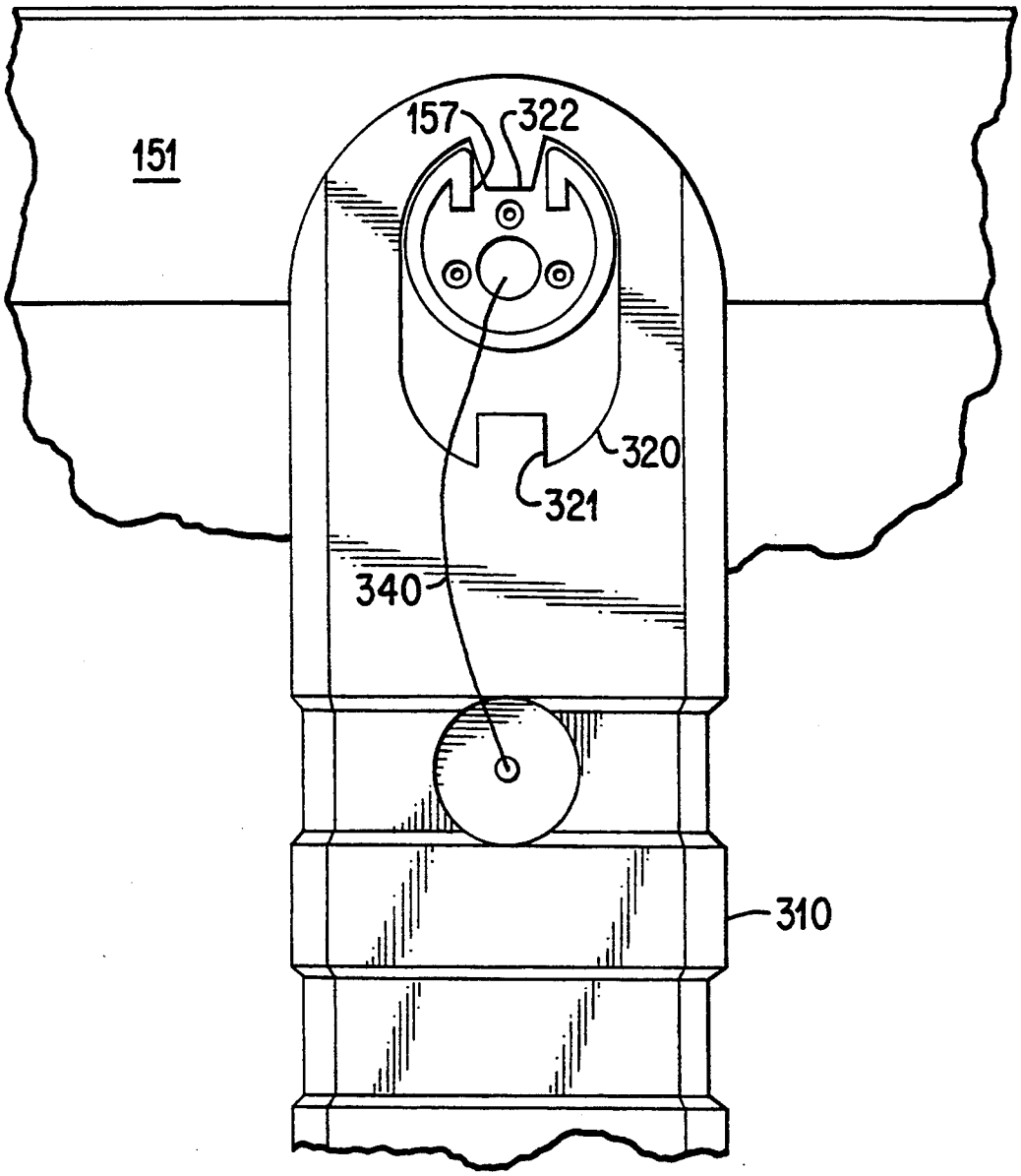

The movement of the support post 310 between the positions depicted in FIGS. 17A and 17B will now be explained in more detail making reference to FIGS. 18A, 18B, 18C, and 18D. In FIG. 18A, the support post 310 is in the upright, play position with upper key 321 held by the slot 157. In FIG. 18B, the support post 310 is lifted to disengage the key 321 from the slot 157. FIG. 18C shows the support post 310 in an intermediate position as it is being rotated in the direction indicated by arrow A. FIG. 18D shows the support post 310 in the inverted, stowed position with the lower key 322 held by the slot 157.

The method of moving the support post 310 is as follows. To release the support post 310 from one vertical position, the support post 310 is first lifted so that the key 321 or 322 clears the slot 157 into which it was engaged. The support post 310 is able to be lifted in this manner due to the vertical clearance C provided between the lower portion of projection 155 and the respective key 321 or 322 at the lower portion of aperture 320. Once the key 321 or 322 clears slot 157, the post is free to be rotated about the post pivot axis 311 until the support post 310 reaches its other vertical position. At the other vertical position, the other key 321 or 322 will engage the slot 157 to hold the post 310 in that position.

In the preferred embodiment, the upper key 321 has a square shape, and provides a relatively tight fit in slot 127 to reduce wobbling of the support post 310 when in the upright, play position, and the lower key 322 is tapered as shown to facilitate lifting and rotating support post 310 from the inverted, stowed position.

Referring to FIGS. 13F and 20, a tab 158 may be provided on back end 151 adjacent projection 155, that fits within a radial groove 323 provided in support post 310. The engagement of the tab 158 in the groove 323 limits rotation of the support post 310 so that it can only be rotated in a slightly greater than 180 degree arc, rather than 360 degrees. This prevents the twisting and tangling of cable 340 that may be caused by several rotations in only one direction.

Referring now to FIGS. 1 through 4, 12, 15A, 15B, 15C and 15D, when the support post 310 is in the play position, the basketball return net 900 can be strung so that it is supported above the main body 100 extending between front net supports 910, 911 and rear net supports 920, 921. The return net 900 has a player end 901 and a back end 902 extending under the rim 370, and is shaped to catch both completed baskets and thrown balls that miss the basket and to return each thrown ball and hold it at the player end 901. The player end 901 of the net 900 is wide enough to hold two or more balls for convenient access by the player.

Figure 15A:
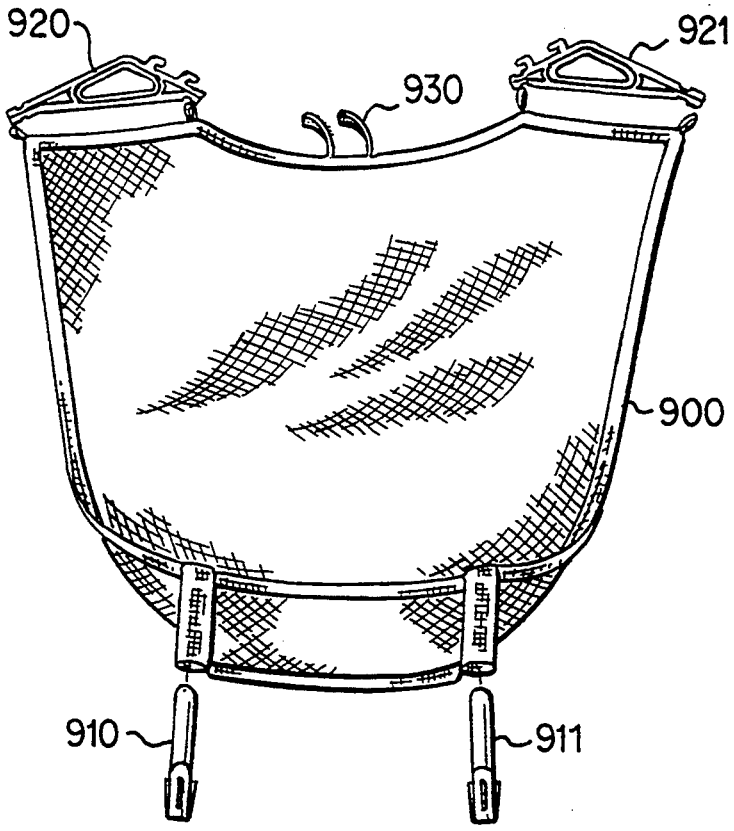
FIGS. 15A, 15B, 15C and 15D show the process by which the basketball return net is mounted to the backboard with upper net supports and on the housing by front net supports.
Figure 15B:
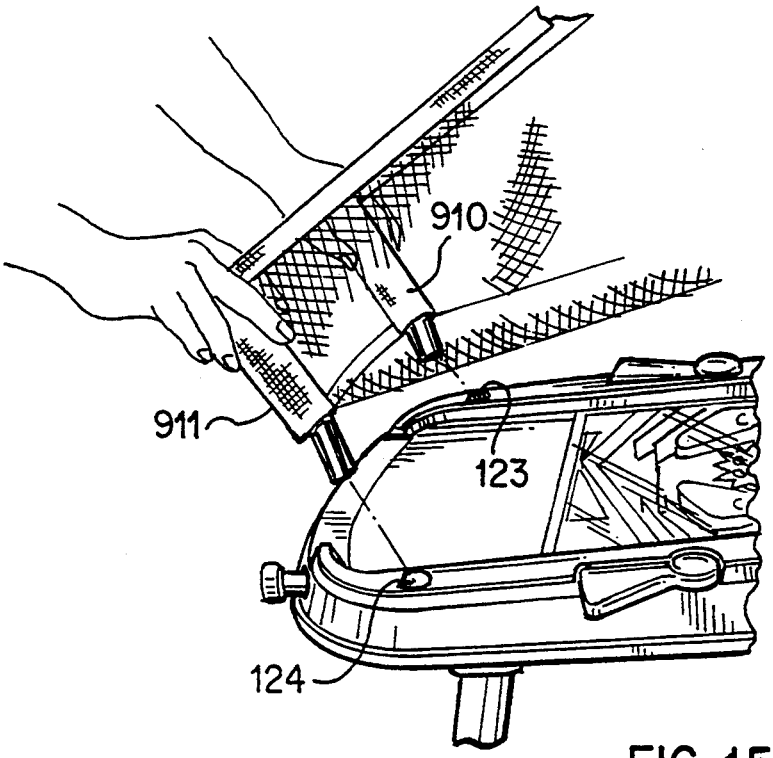
Figure 15C:
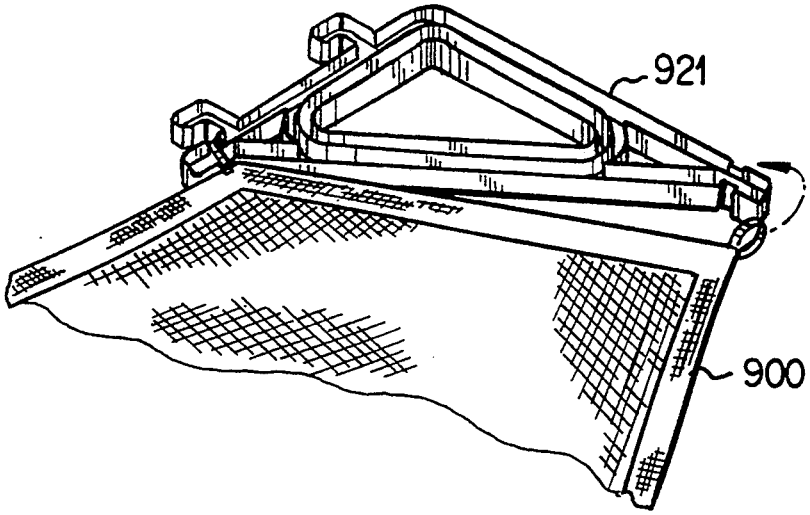
Figure 15D:
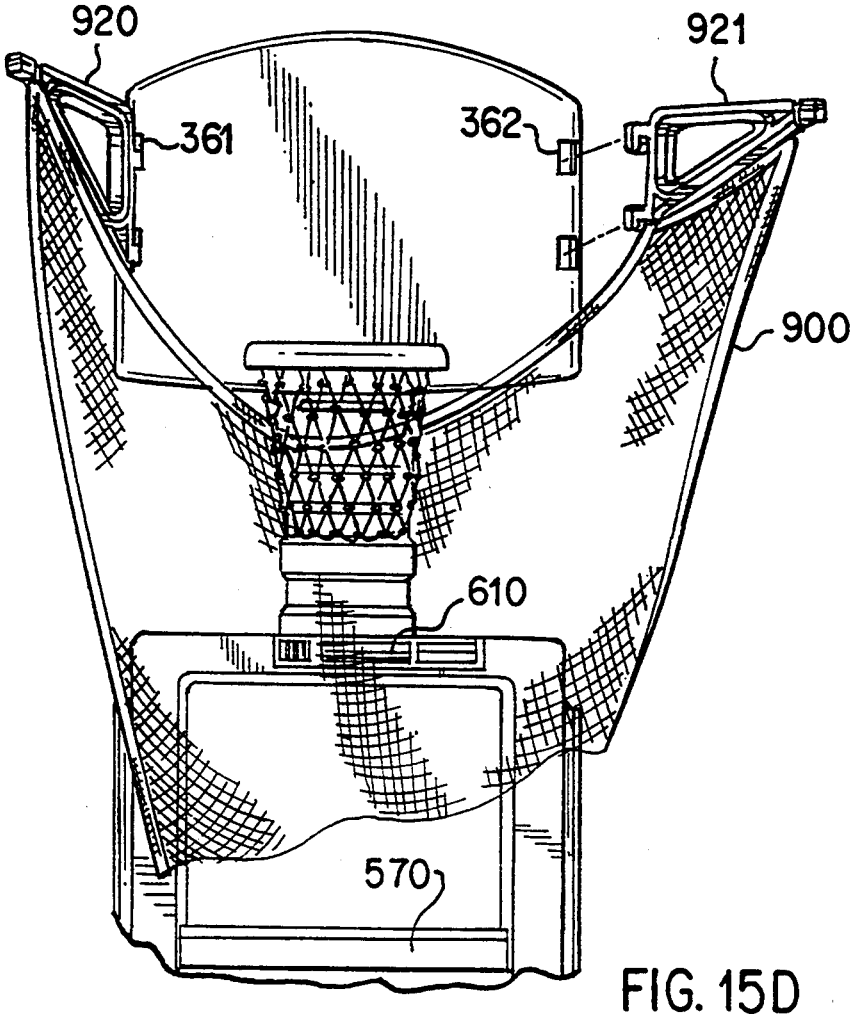

The front net supports 910, 911 are detachably mountable into sockets 123, 124 located near the player end 122, and the rear net supports 921, 922 are detachably mountable to the backboard assembly 350 by hooks that are inserted into slots 361, 362 provided in the backboard 360. As shown in FIGS. 1 and 15A, a strap 930 held by hook-and-loop fastener is wrapped around the support post 310 to further secure the back end 902 of the net 900 in place. This arrangement allows the net supports 910, 911, 920, 921 and return net 900 to be easily removed before the support post 310 is rotated to the stowed position.

Pinball Assembly

Figure 8:
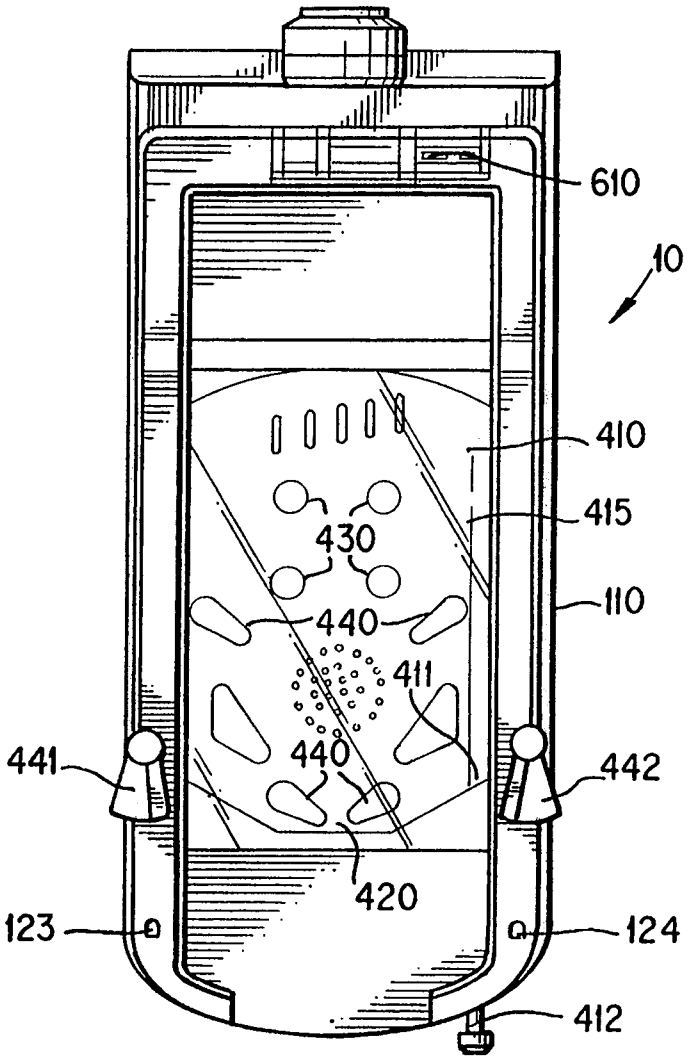
FIG. 8 is a top plan view of the apparatus shown in FIG. 5.
Figure 6:
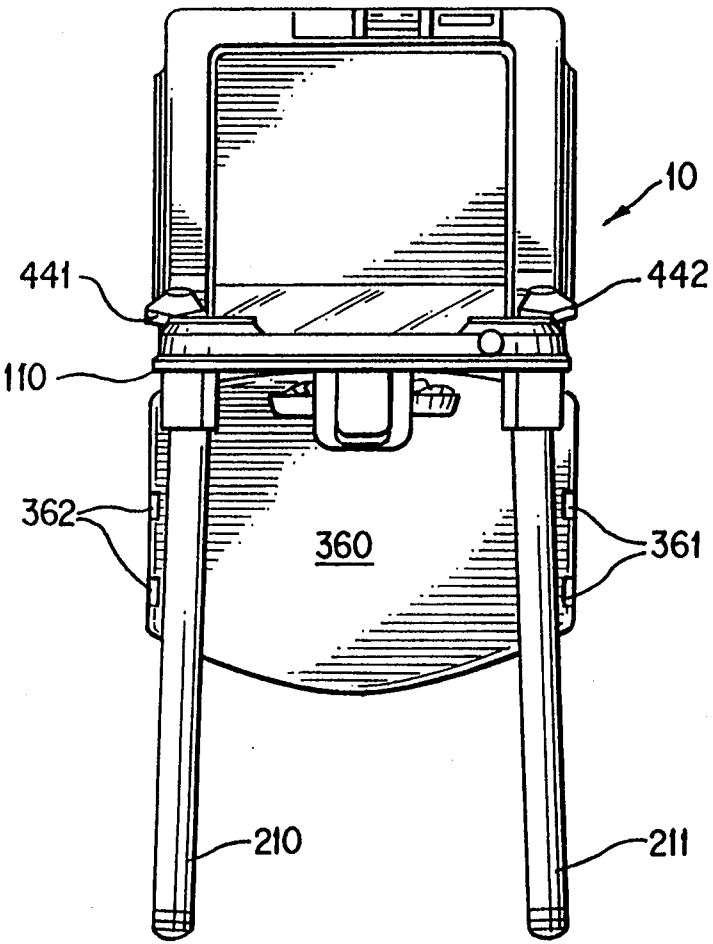
FIG. 6 is a front elevation of the apparatus shown in FIG. 5.
Figure 9:
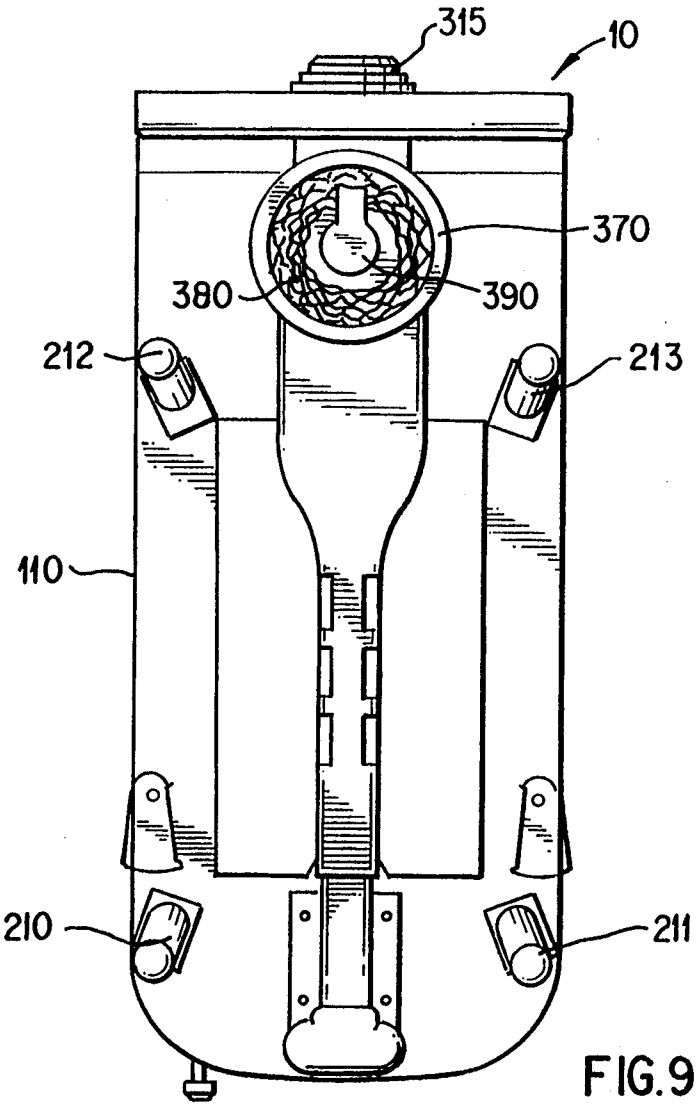
FIG. 9 is a bottom plan view of the apparatus shown in FIG. 5.
Figure 7:
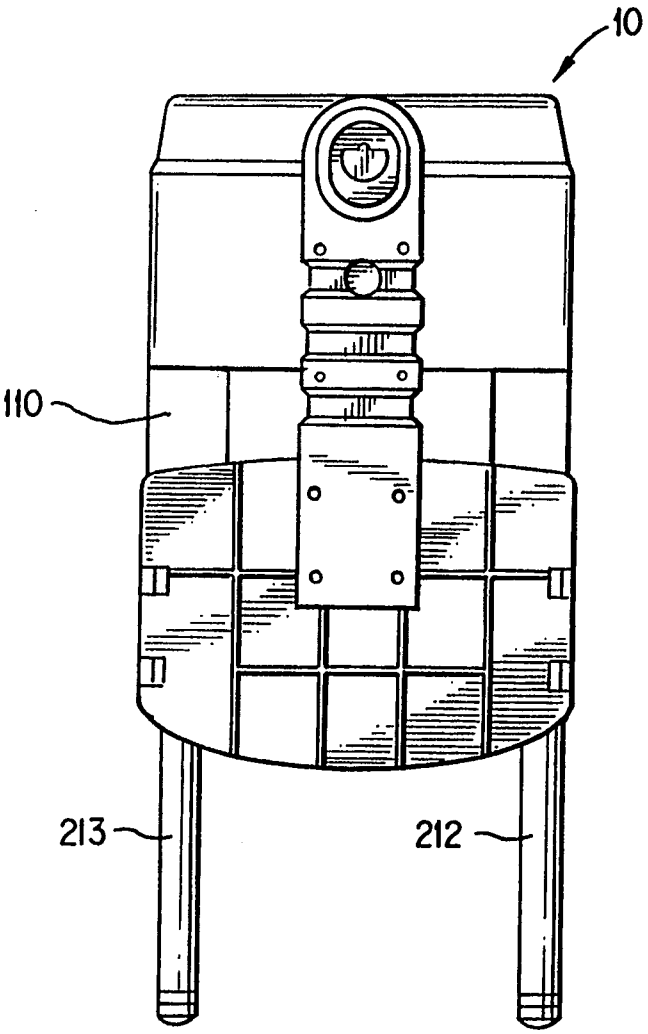
FIG. 7 is a rear elevation of the apparatus shown in FIG. 5.
Figure 11:
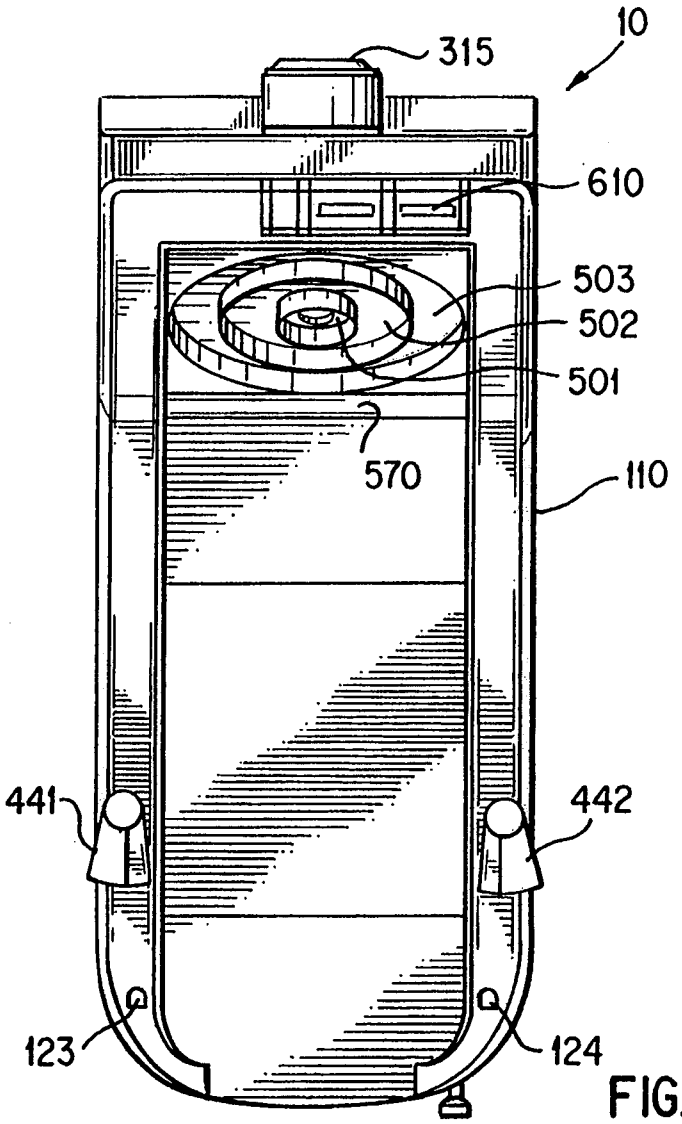
FIG. 11 is a top plan view of the apparatus shown in FIG. 10.
Figure 10:
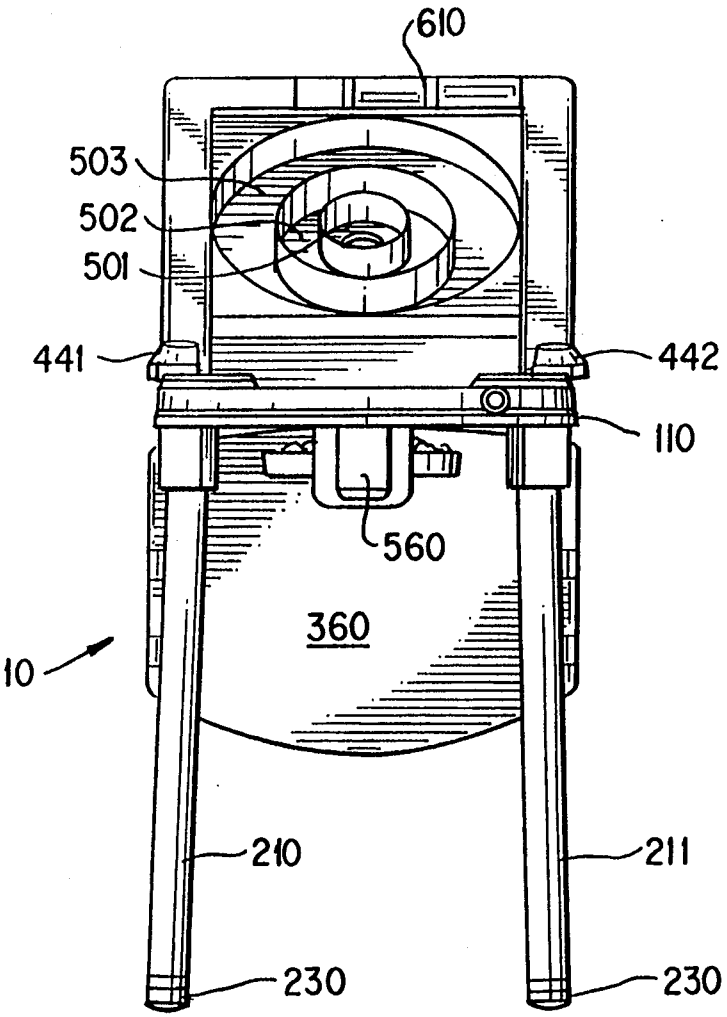
FIG. 10 is a front elevation view of the combination arcade game apparatus with the backboard support post in the stowed position and the target bowling target exposed.
Figure 12:
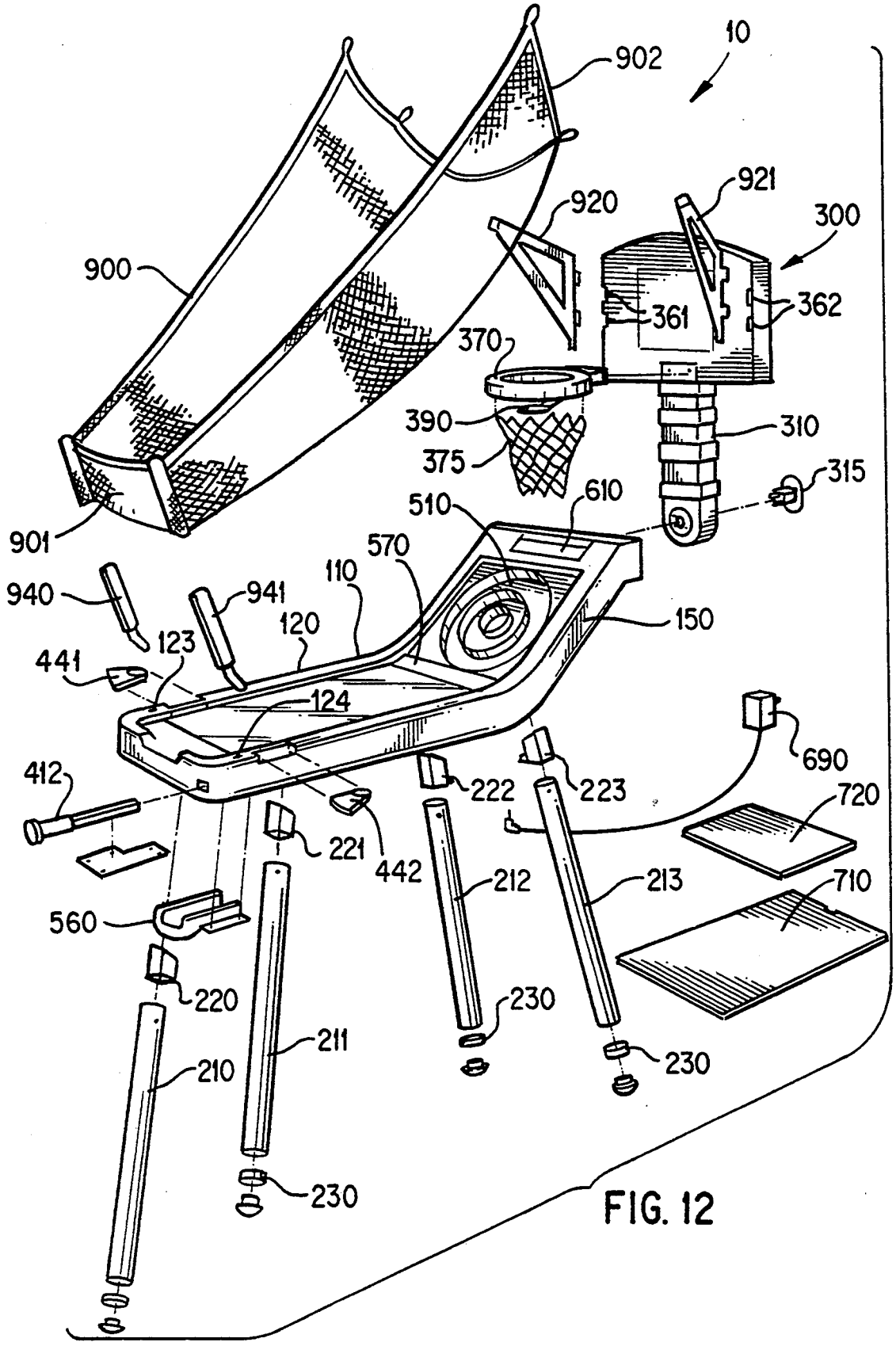
FIG. 12 is an exploded view of the game in the configuration shown in FIGS. 1 through 4.
Figure 14B:
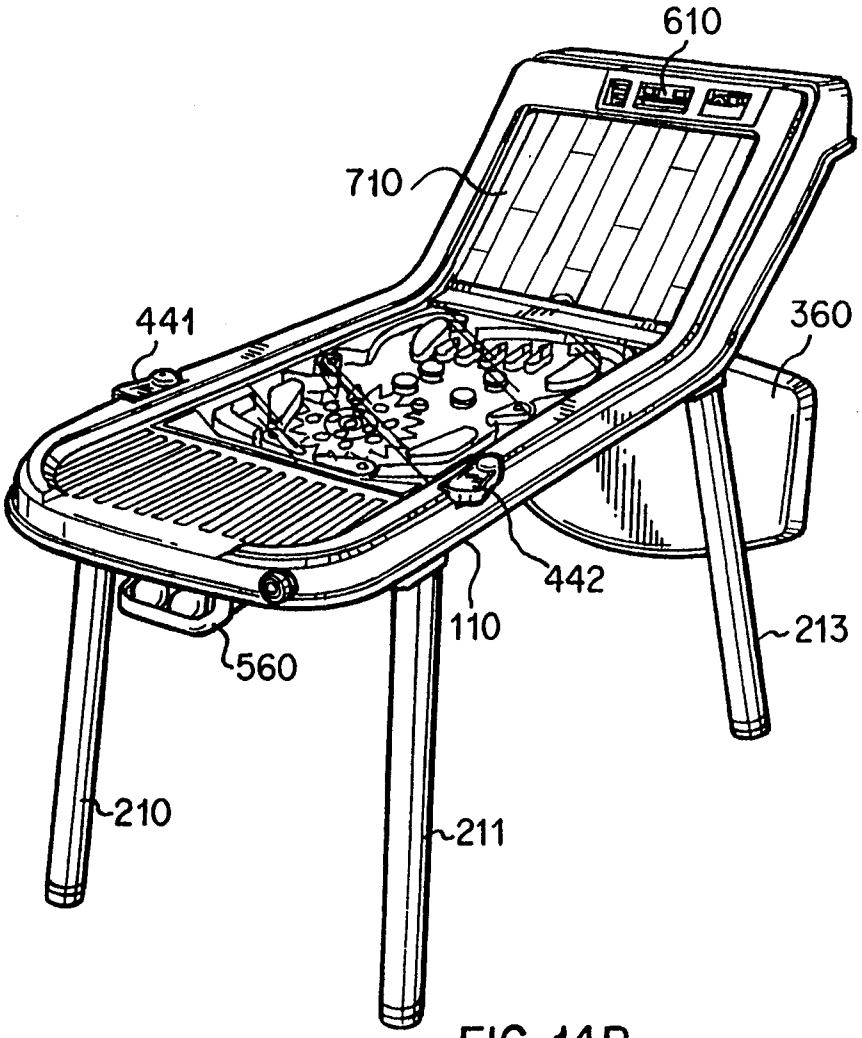
FIGS. 14A and 14B are perspective views showing the game in a target bowling mode and a pinball mode, respectively.
Figure 14A:
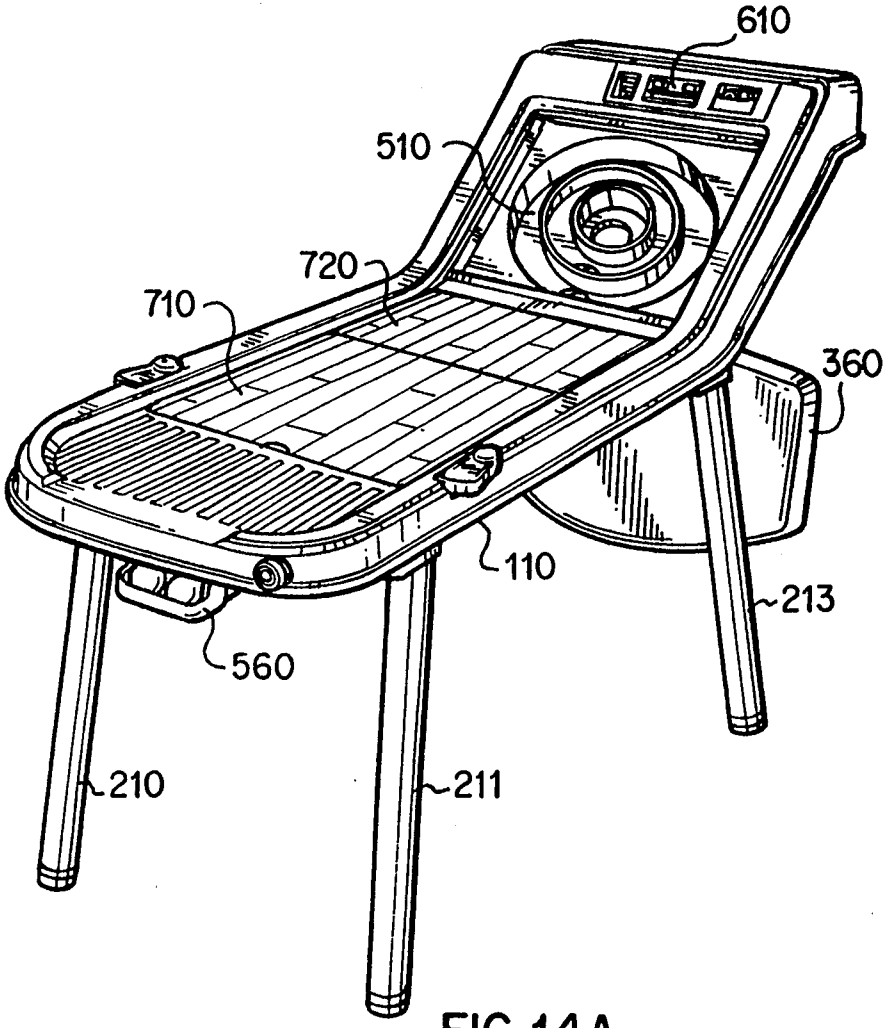

The pinball apparatus 400, best shown in FIGS. 8 and 14B is housed in pinball cavity 130 of coffin 120, and includes conventional pinball game structures such as a slanted pinball playfield 410 down which a pinball rolls under the influence of gravity and a transparent plastic top panel 415 overlying the playfield 410. A pinball is projected to the top of the playfield by operating a spring-loaded ball launcher 411 having a launcher handle 412 that extends from the player end 122 of coffin 120. As the pinball rolls down towards one or more exits 420, it contacts various scoring features such as bumpers 430 and other scoring elements, while the player attempts to keep the pinball in play by projecting it back up the playfield 410 using flippers 440 by pressing on flipper actuators 441, 442 mounted on each side of the coffin 120 near the corners at the player end 122. Flipper actuators 441, 442 operate the flippers 440 via a direct mechanical linkage. The bumpers 430 may be driven by a motorized mechanical drive system such as that disclosed in U.S. Pat. No. 4,223,889 to Konta, which patent is incorporated herein by reference. Other mechanically powered scoring features such as saucers, ramps, or tubes with motorized ball kickers may be provided. Lights, such as LED's or other visual elements may also be provided on the playfield 410 to display visual patterns based on scoring activity.

When the ball rolls into one of the exits 420, it enters a pinball return structure 421, which returns the ball to a start location for launching by the ball launcher 411 to start play again.

Various pinball game functions such as providing power to the bumpers and other game features and conventional electronic scoring are controlled as needed by the scoring and control system 600, discussed in more detail below.

Figure 16B:
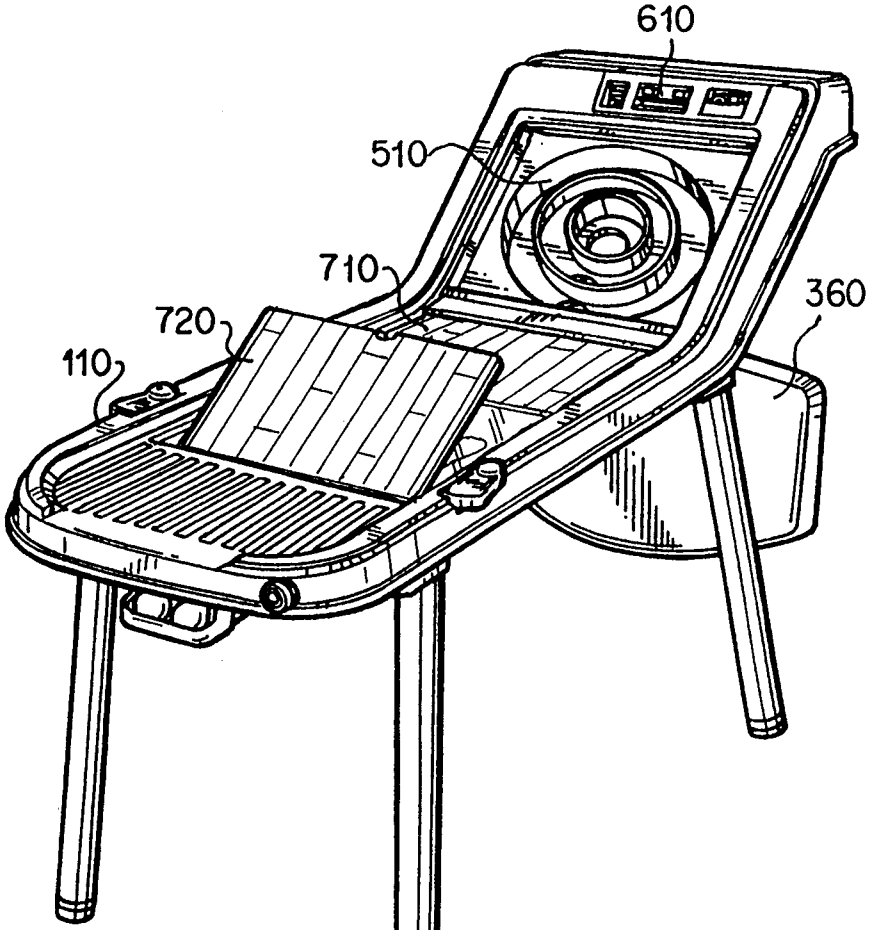
FIGS. 16A and 16B show the arrangements of large and small covers placed on the housing to transition between the pinball and target bowling modes.
Figure 16A:
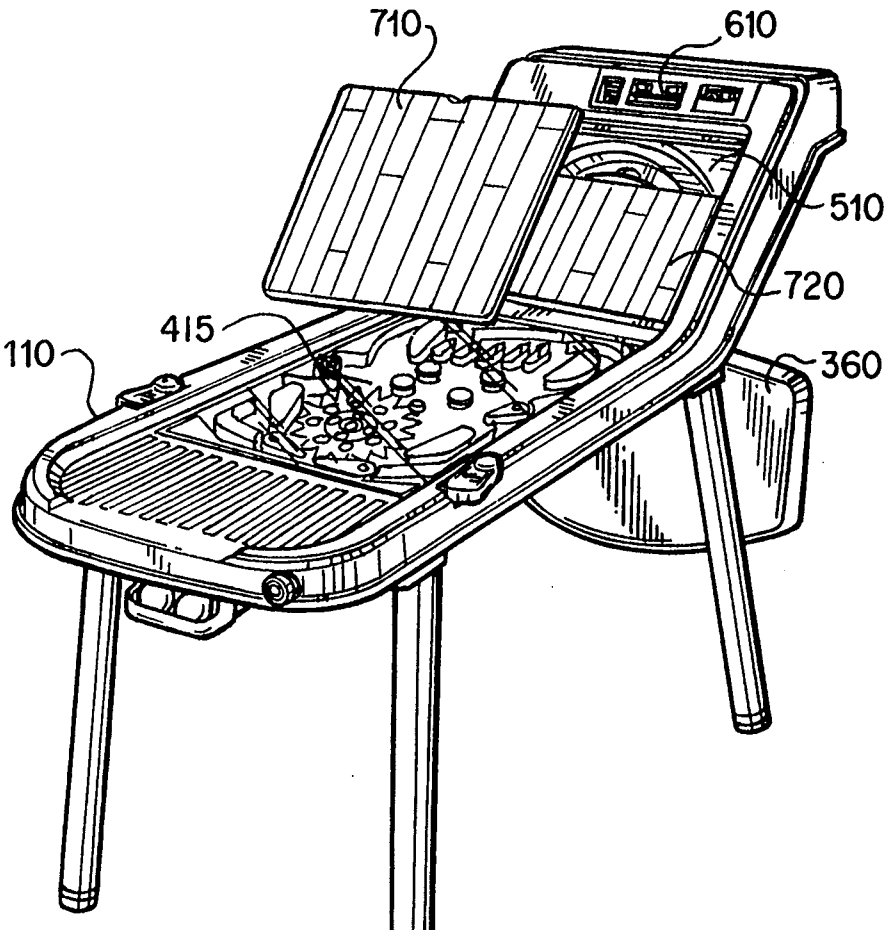

When the apparatus is in the pinball configuration, the target 510 of the target bowling apparatus 500 may be covered by a large cover panel 710, placed over a small cover panel 720 as shown in FIGS. 8, 14B and 16A. The large cover panel 710 may bear a colorful graphic on the exposed side, as is traditional for arcade pinball machines.

Target Bowling Assembly

To play target bowling, as shown in FIG. 10, 11, 14A and 16B, a conventional target 510 mounted in the back case 120 is exposed for play by removal of the cover panels 710, 720. The large cover panel 710 and small cover panel 720 are placed end to end atop the top panel 415 of the pinball apparatus 400 to define an alley along which a ball can be rolled. The cover panels 710 and 720 may each have a graphic on one side to simulate a wood alley or other suitable target bowling alley surface.

The target 510 includes multiple concentric scoring rings towards which a ball is projected by being rolled down the alley. A ramp 570 is formed at the lower edge of the target 510, located at the end of the alley away from the player, so that the ball is projected by the ramp 570 towards the target 510.

Figure 22:
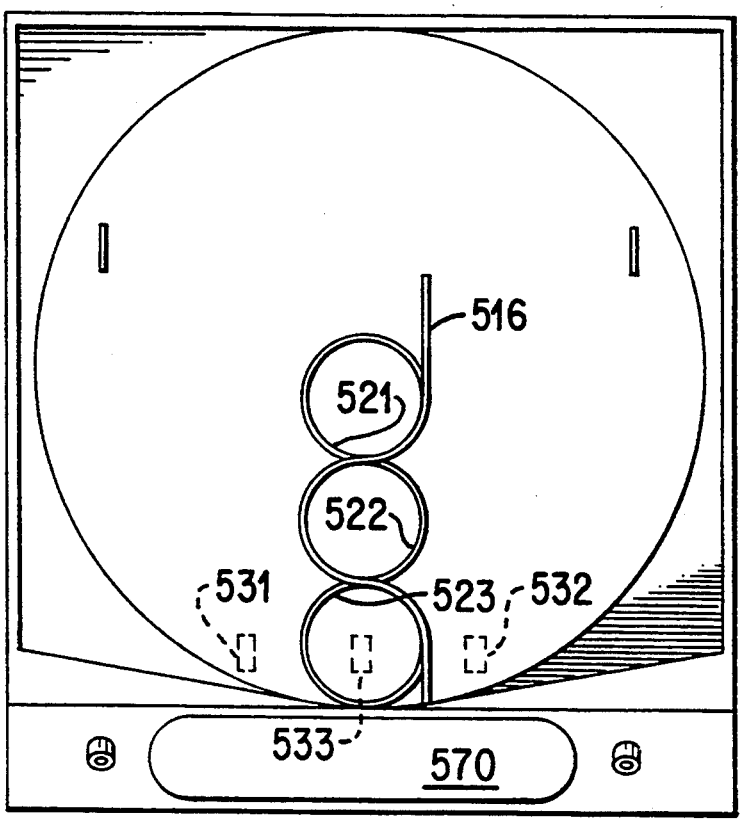
FIG. 22 is a rear view of the target bowling target component.

Referring now to FIGS. 10 and 11, 16B and 22, the target 510 includes scoring areas 501, 502, and 503 each divided by upstanding rings. Each scoring area includes a hole 521, 522, 523 passing through the target 510 through which the ball falls to exit the scoring area. As shown in FIG. 22, a curved guide wall 516 on the back side of the target 510 guides the ball into one of three lanes 511, 512, 513 provided at the wide upper end of ball return channel 550 (see FIG. 13A) according to which of the holes 521, 522, 523 the ball exits through.

Contact-type scoring sensor switches 531, 532, 533 located behind the scoring ring in each lane 511, 512, 513, respectively, identify which ring the target bowling has landed in by sensing the passage of the ball through one of the lanes 511, 512, 513. FIG. 13A shows the positioning of the lanes 511, 512, 513 and sensor switches 531, 532, 533. The lanes and switches may be provided on a mounting member that is mounted to housing 110. In FIG. 22, the placement of the sensor switches 531, 532, 533 relative to the guide wall 516 at the target 510 is shown by broken lines. The sensor switches 531, 532, 533 communicate with the scoring and control system 600, which counts the score for that roll.

After the ball passes through one of the lanes 511, 512 and 513, it rolls through the ball return channel 550 formed in the housing, which is angled slightly downward to feed the ball into a return extension 560 mounted at the player end of return channel 550. The return extension 560 is shaped to hold two or more balls in a manner so that they are readily accessible to the player.

Scoring and Control System

Figure 21:
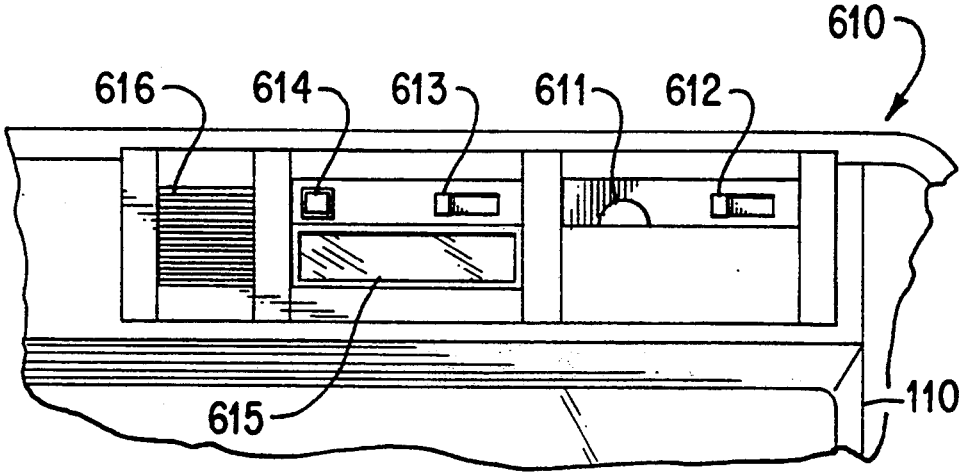
FIG. 21 shows a scoring and control module.

The scoring and control system 600 includes a control and display module 610 illustrated in FIG. 21 having an on/off and volume control knob 611, a number-of-players selector switch 612, and a game selector switch 613 that allows the user to choose between pinball, basketball, and target bowling operation modes. A high score recall button 614 may also be provided. The control and scoring display module 610, which, in the illustrated embodiment, includes six seven-segment LED elements, also includes alpha-numeric display 615 to indicate game modes and scoring information. A speaker 616 for emitting appropriate game sounds is also located in the control and scoring display module. The scoring and control system 600 receives power from a conventional power supply cord 690 connected to housing 110. Although the knob 611, switches 612 and 613, button 614, display 615 and speaker 616 are described as located together in a single, integrated module, they may be disposed separately on various parts of the overall apparatus 10.

Figures 23, 23A, 23B, 23C, 23D, 23E, 23F:
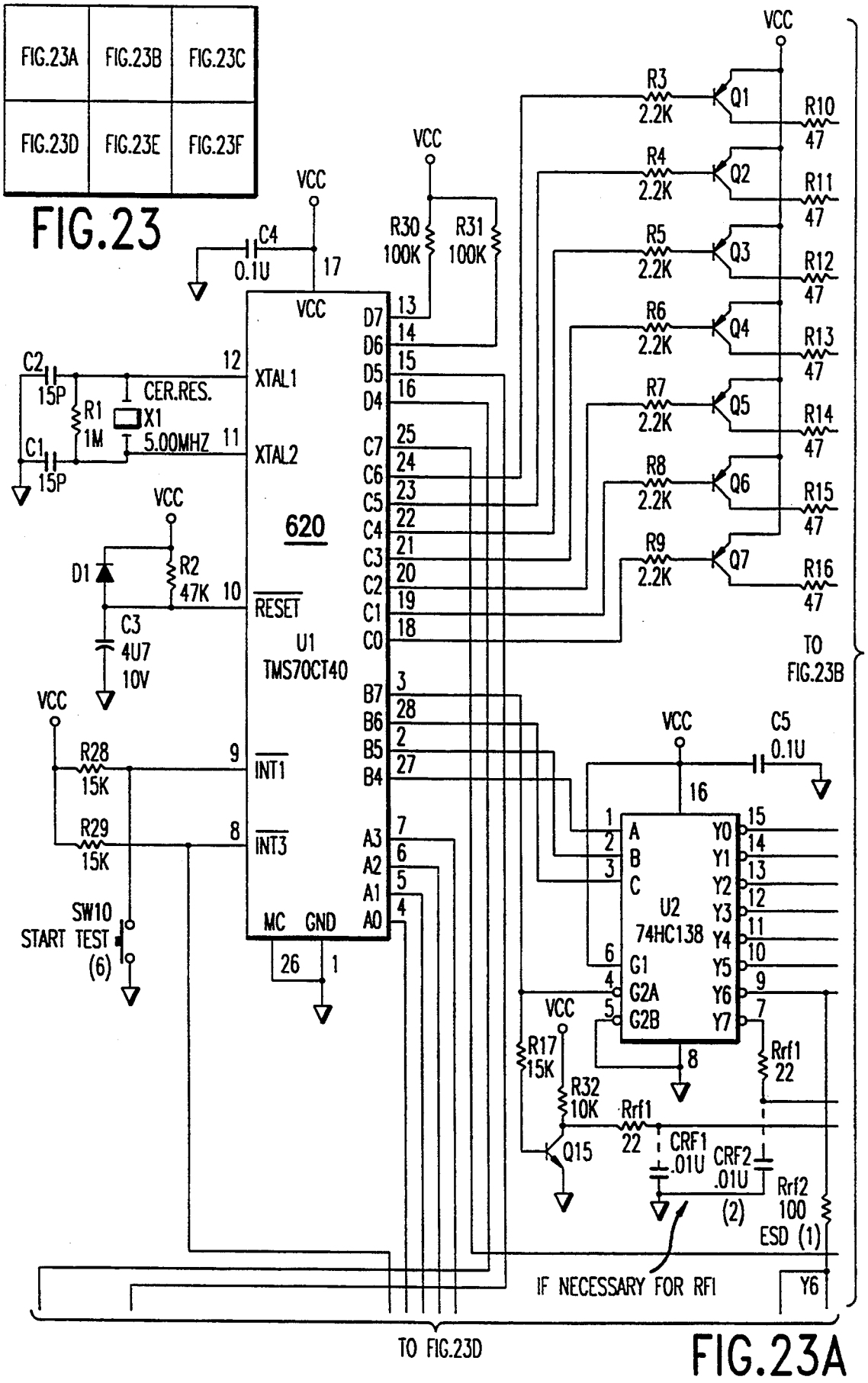
FIG. 23 including
FIGS. 23A, 23B, 23C, 23D, 23E and 23F, is a schematic diagram of the circuits associated with the scoring and control module.
Figure 23B:
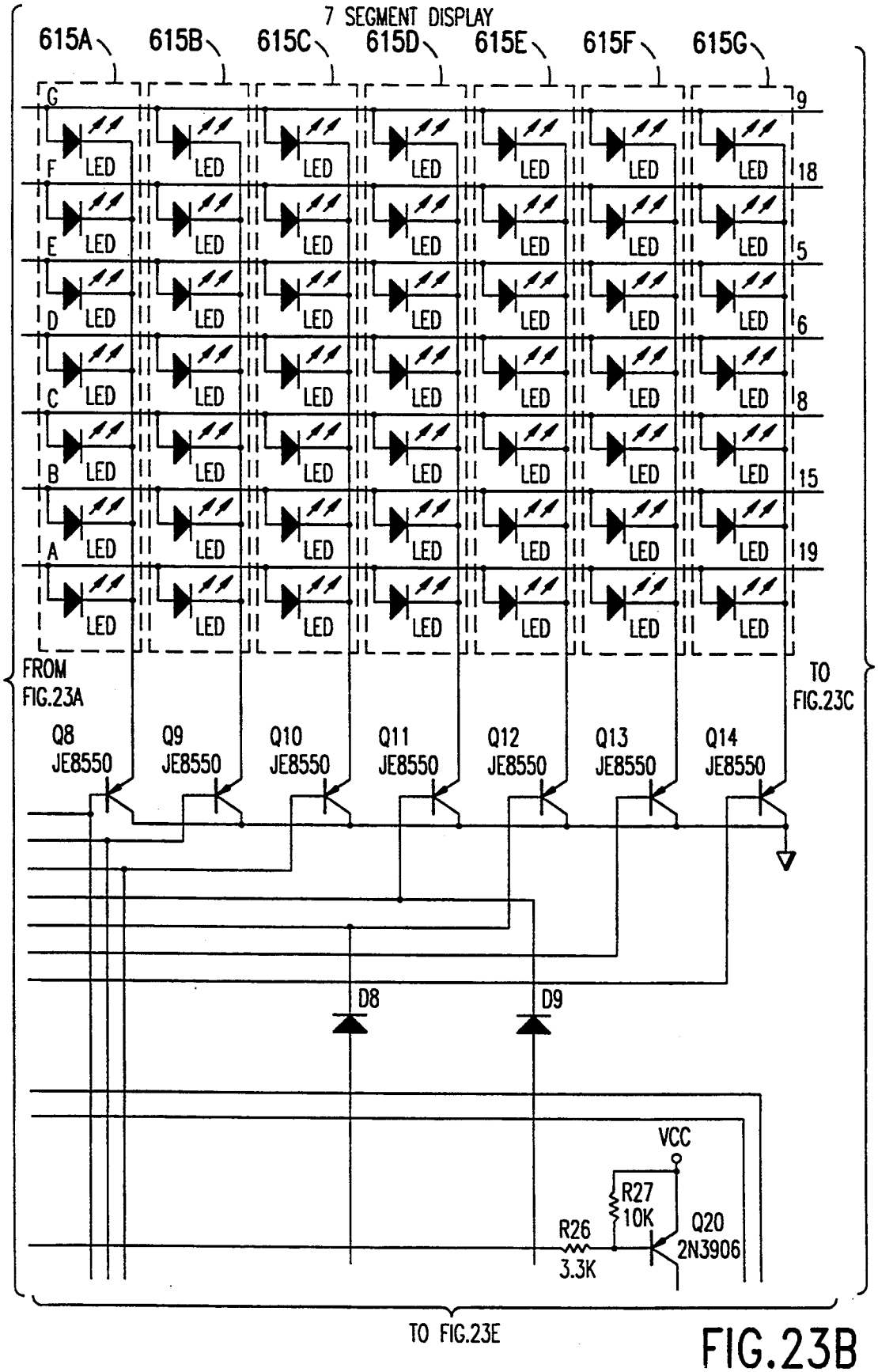
Figure 23C:
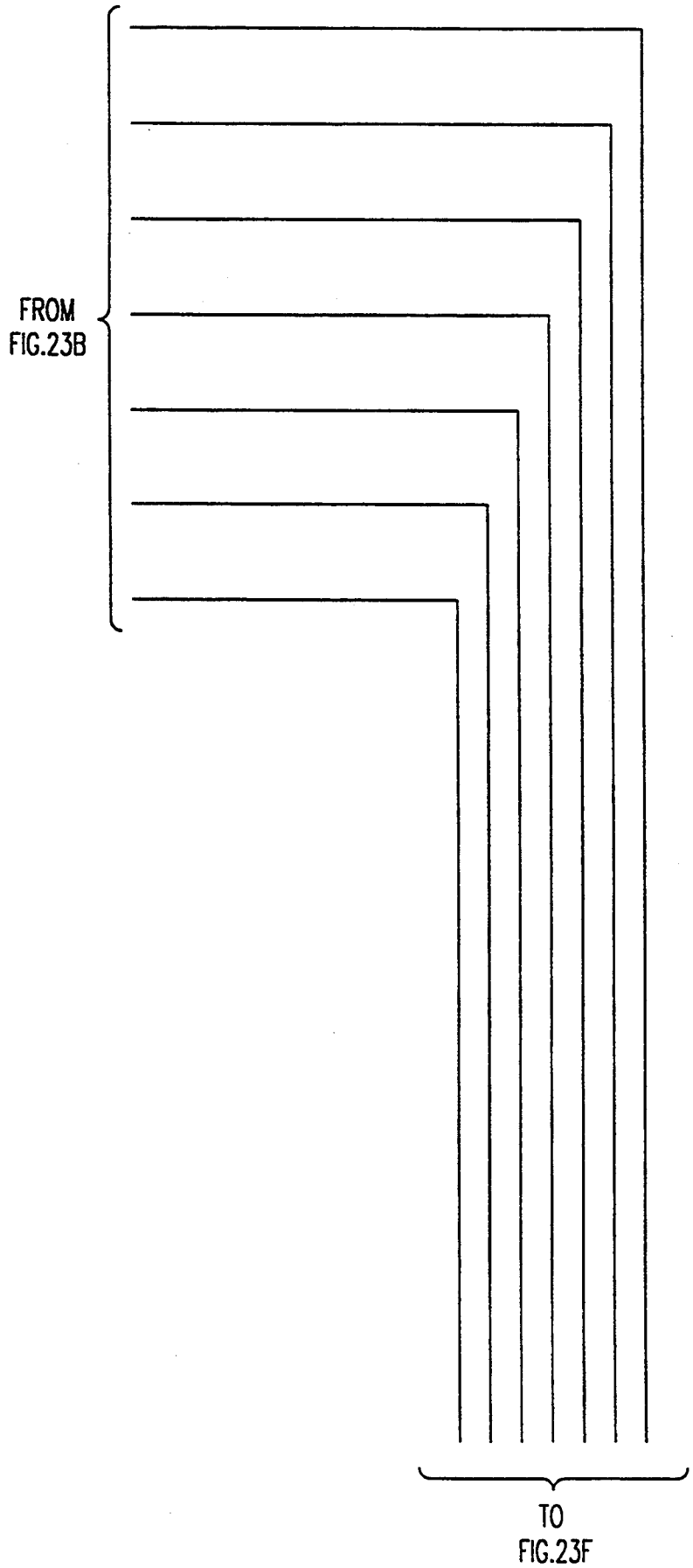
Figure 23D:
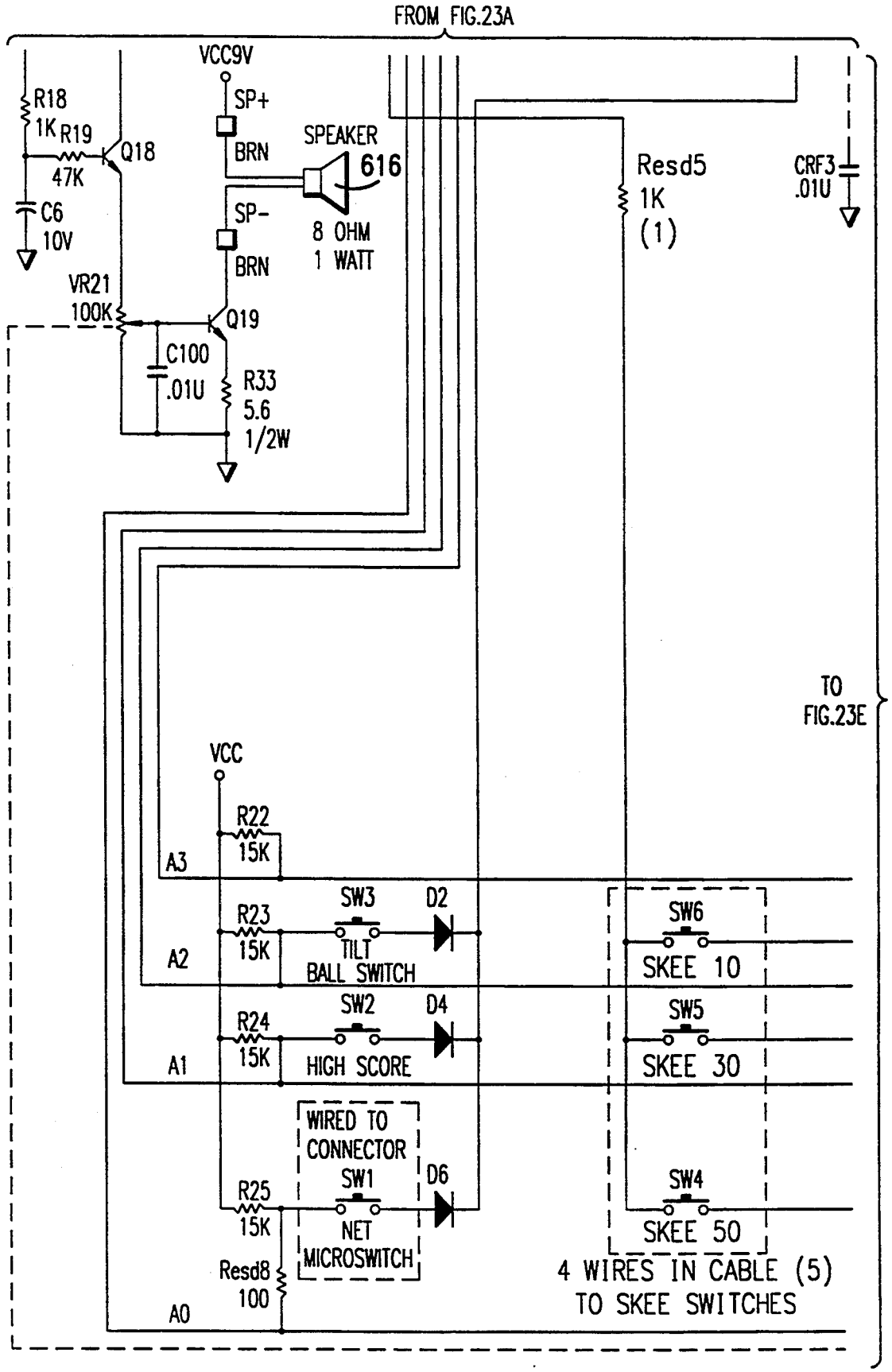
Figure 23E:
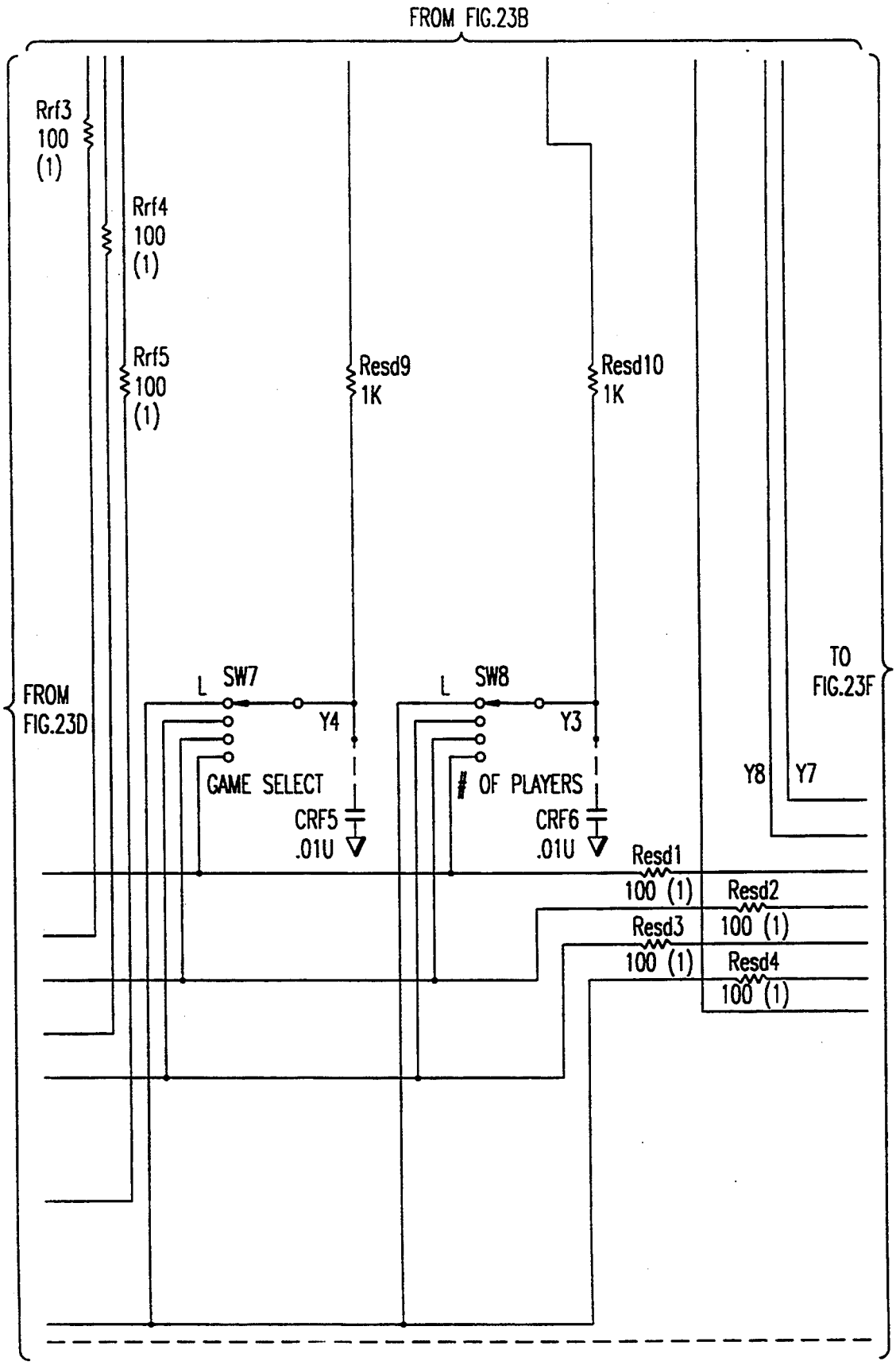
Figure 23F:
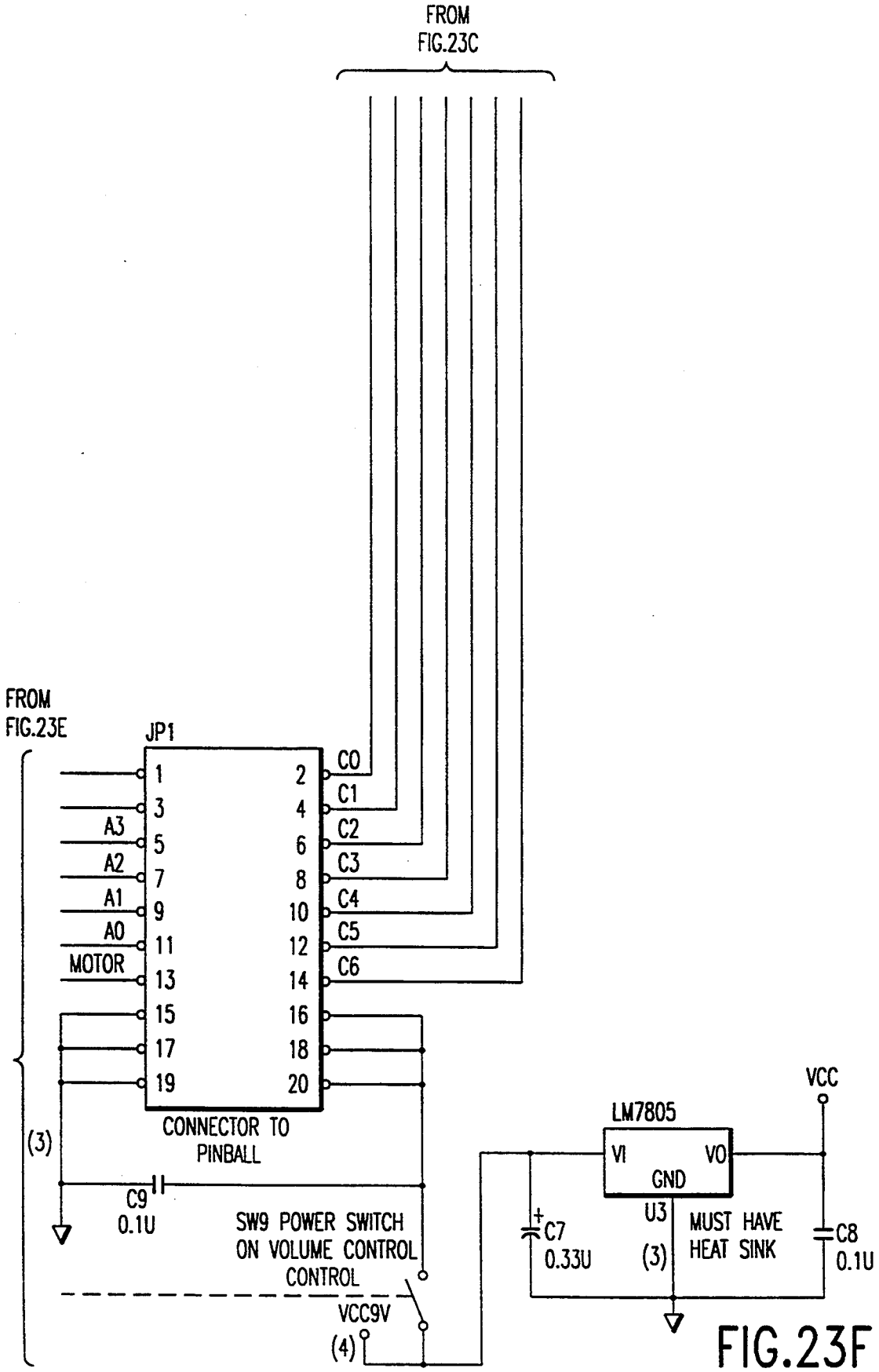

As discussed above, the scoring and control system 600 communicates with a paddle-activated scoring switch located in basketball assembly 300, with scoring sensors 531, 532, 533 located in target bowling assembly 500, and with pinball apparatus 400. FIG. 23 schematically represents circuits used in the scoring and control system 600. In the preferred embodiment, these circuits are provided in scoring and display module 610. FIG.

24 schematically represents circuits that are associated directly with the pinball apparatus 400. Although these circuits are also considered part of scoring and control system 600, in the preferred embodiment they are located in the pinball apparatus 400.

Referring to FIG. 23, the scoring and display module 610 includes a micro-processor 620 that receives inputs from the various scoring sensors as shown. The microprocessor 620 also contains software to control the various game functions. The display 615 includes seven seven-segment LED displays 615A, 615B, 615C, 615D, 615E, 615F and 615G, which are driven by outputs from the micro-processor 620. A power and volume switch SW9 corresponds to the on/off and volume knob 611 and provides power and a volume input to the microprocessor 620 and speaker 616. A tilt switch SW3 detects tilting of the apparatus, causing an input to the micro-processor 620 to stop the scoring for a ball in play. Pushing the high-score recall button 614 closes switch SW2, which provides an input to the microprocessor 620 to cause the display to indicate the high score attained since the apparatus was turned on. A basketball scoring switch SW1 is closed by deflection of the score paddle 390 to provide an input corresponding to a completed basket to the microprocessor 620. The switches SW4, SW5, and SW6 are closed by target bowling sensors 533, 532, and 531 respectively, and provide inputs to the microprocessor 620 corresponding to target bowling scores. The number-of-players switch SW8 corresponds to number-of-players selector 612, and provides an input to the microprocessor corresponding to the number of players. The game select switch SW7 corresponds to game selector 613 and provides an input to the microprocessor 620 indicating which of the scoring sensor inputs are to be used for scoring. The connector JP1 connects the main portion of the scoring and control system 300 shown in FIG. 23 to the pinball circuits shown in FIG. 24.

Figures 24, 24A:
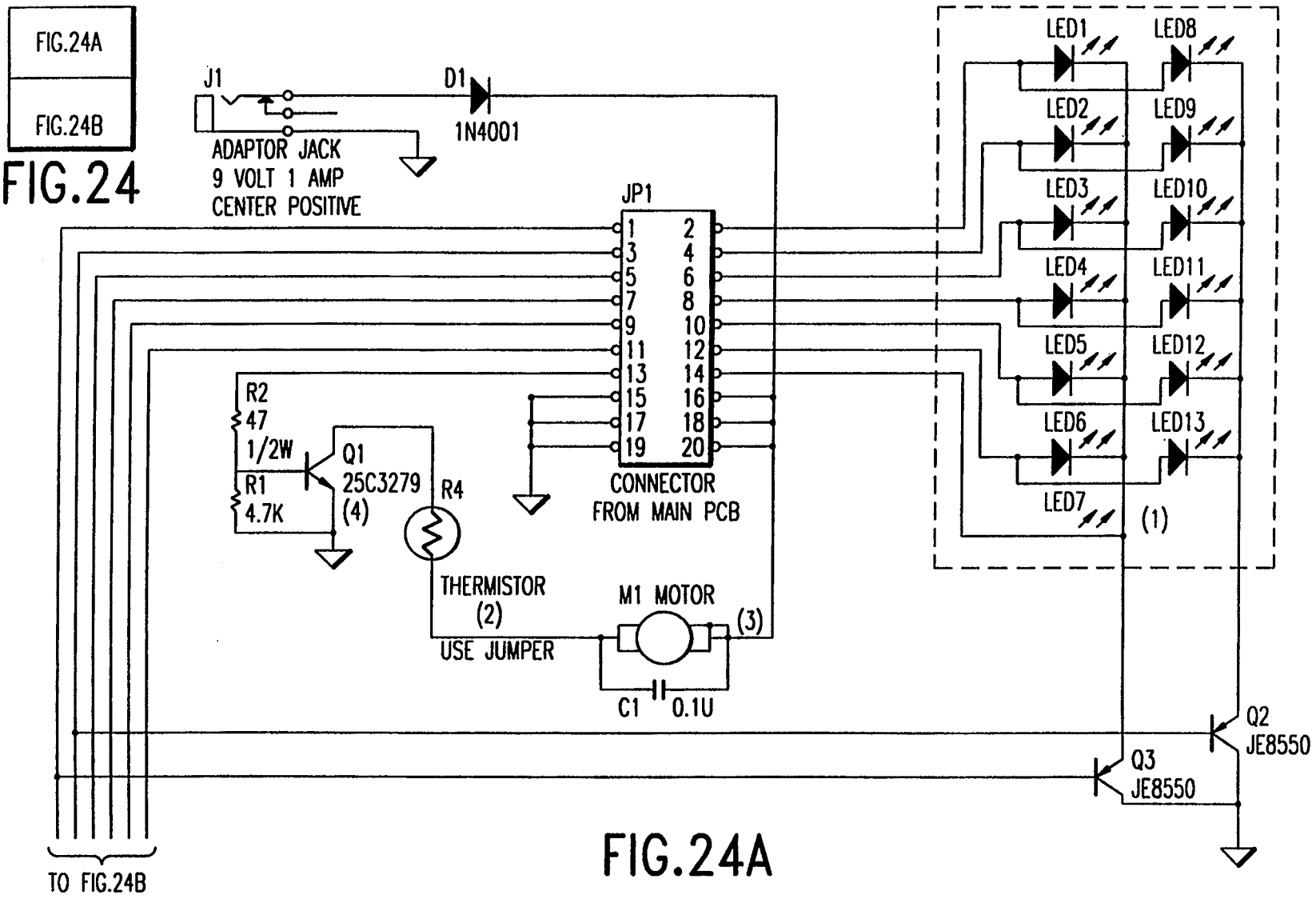
FIG. 24 including
FIGS. 24A, and 24B is a schematic diagram of the circuits associated with the pinball game apparatus.
Figure 24B:
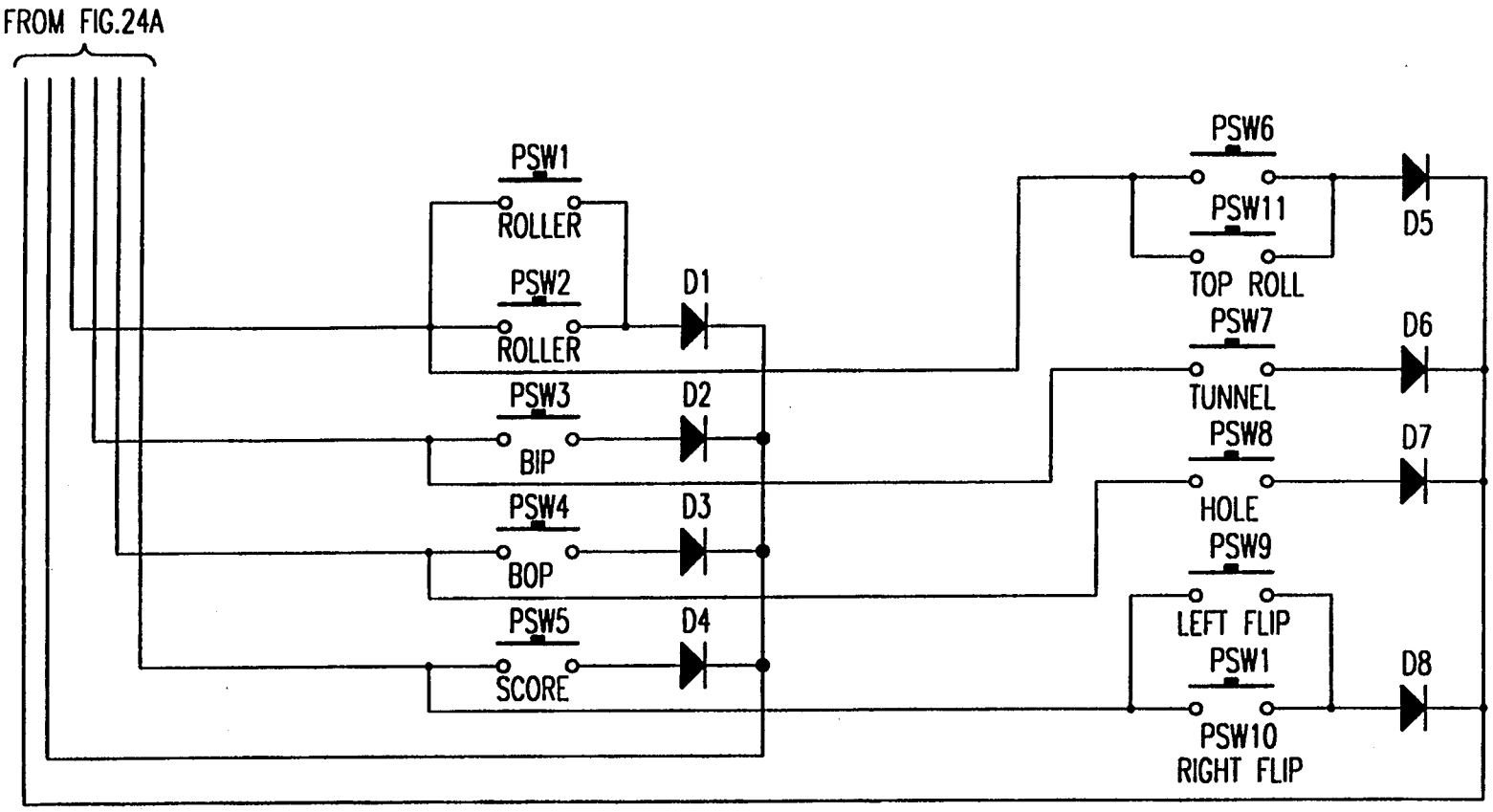

Referring now to FIG. 24, the LED elements LED 1 through LED13 are visual display elements provided on the surface of the pinball playfield 410, which are driven by outputs from the micro-processor 620. The motor M1 mechanically drives the bumpers 430 and other power-driven pinball features and is controlled by an output from microprocessors 620 so that the motor M1 operates only when the game selector switch SW7 corresponding to the game selector 613 is set in the pinball setting. The roller switches PSW1 and PSW2 (roll-over switches provided on the playfield 410), the tunnel switch PSW7, the hole switch PSW8, and the switches PSW6 and PSW11 (connected to other scoring features on the playfield 410), provide a scoring input to the microprocessor 620. The switches PSW3 and PSW4 include playfield switches and provide a ball-in-play input and a ball-out-of-play input, respectively, to the microprocessor 620. The left and right flipper switches PSW9 abd PSW10 provide input to the microprocessor 620 when the flippers are actuated.

The operation of the scoring and control system 600 shown in FIGS. 21, 23 and 24 will now be described. Initially, the on/off and volume control knob 611 is rotated from the off position to supply power to the scoring and control system 600 and to set the desired volume. Then the player selects the number of players using the number of players switch 612 and selects the type of game using game selector switch 613. In the preferred embodiment, four game settings are available.

In the target bowling setting, the scoring and control system 610 responds to the target bowling scoring sensors 531, 532, 533, and display 615 displays the player's total score for the game. The display 615 may also display the player number of the player whose turn it is.

Two basketball game settings are available—in both settings, the scoring and control system 610 responds to the basketball scoring sensor switch, and the display 615 displays the player's total score for the game. The display 615 may also display the player number of the player whose turn it is, and a count-down timer indicating time remaining until the end of a turn. In the preferred embodiment, power is not supplied to the active pinball functions in pinball apparatus 400—such as the powered bumpers, motorized ball kickers, or playfield LED's—when in the target bowling or basketball settings.

In the pinball setting, the scoring and control system 600 is responsive to scoring elements in the pinball apparatus by means of the circuits shown in FIG. 24. The display 615 displays the player's total score, and may also display the player number of the player whose turn it is and the number of balls played so far. Also, in the pinball setting the scoring and control system 600 provides power to activate the powered bumpers, the motorized ball kickers and the playfield LED's.

What is claimed is:

1. A game apparatus for playing target bowling and pinball, comprising:

a housing having a generally horizontal coffin portion having a proximate, player end, a distal, back end, and an upper surface thereon, and a back case portion generally inclined at an angle relative to said upper surface and having a first, lower end and a second, upper end;

a ramp disposed between said back end of said coffin portion and said lower end of said back case portion and having one end approximately contiguous with said upper surface;

a pinball apparatus disposed in said coffin portion below said upper surface; and a target bowling scoring apparatus disposed in said back case, whereby a ball rolled across said upper surface toward said back case portion is projected toward said target bowling scoring apparatus by said ramp.

2. The apparatus of claim 1, further comprising:

a pinball scoring apparatus; and a scoring indicator selectively responsive to at least one of said pinball scoring apparatus and said target bowling scoring apparatus.

3. The apparatus of claim 2, further comprising a control device having a game select switch for determining which one of said pinball scoring and target bowling scoring apparatuses said scoring indicator is responsive to, and for selectively causing power to be supplied to said pinball apparatus.

4. The apparatus of claim 2, wherein said scoring indicator is disposed in said back case portion.

5. The apparatus of claim 1, further comprising a removable cover for covering said target bowling scoring apparatus.

6. The apparatus of claim 5, ,wherein said cover fits atop at least a portion of said upper surface.

7. A game apparatus for playing pinball and basketball, comprising:

a housing having a coffin portion having a proximate, player end, a distal, back end, and an upper surface thereon;

a pinball apparatus disposed in said coffin portion;

a backboard;

a basketball rim mounted on said backboard; and a backboard support post coupling said backboard to said housing.

8. The apparatus of claim 7, further comprising:

a basketball scoring apparatus;

a pinball scoring apparatus; and a scoring indicator selectively responsive to at least one of said pinball scoring apparatus and said basketball scoring apparatus.

9. The apparatus of claim 8, further comprising a control device having a game select switch for determining which one of said pinball scoring and basketball scoring apparatuses said scoring indicator is responsive to, and for selectively causing power to be supplied to said pinball apparatus.

10. The apparatus of claim 8, wherein said scoring indicator is disposed in said back case portion.

11. The apparatus of claim 8, wherein said basketball scoring apparatus comprises:

a paddle mounted proximate to the rim so that said paddle is displaced by a ball passing through the rim; and a switch activated by displacement of said paddle.

12. The apparatus of claim 7, further comprising:

a basketball return net having an upper end, a lower end, and a body portion therebetween, said upper end being releasably attached to said backboard, said lower end being releasably attached to said coffin portion near said player end of said coffin portion and being disposed lower than said upper end, and said body portion being disposed above said housing and having at least a portion thereof disposed beneath said basketball rim, whereby a basketball dropping through said basketball rim will roll down said basketball return net toward said player end of said coffin portion.

13. The apparatus of claim 7, wherein said backboard support post is coupled to said housing for movement between a first, play position in which said basketball rim is accessible for play and a second, stowed position in which said basketball rim is inaccessible for play.

14. A game apparatus for playing target bowling and basketball, comprising:

a housing having a generally horizontal coffin portion having a proximate, player end, a distal, back end, and an upper surface thereon, and a back case portion generally inclined at an angle relative to said upper surface;

a ramp disposed between said back end of said coffin portion and said lower end of said back case and having one end approximately contiguous with said upper surface;

a target bowling scoring apparatus disposed in said back case portion;

a backboard;

a basketball rim mounted on said backboard; and a backboard support post coupling said backboard to said housing, whereby a ball rolled across said upper surface toward said back case portion is projected toward said target bowling scoring apparatus by said ramp.

15. The apparatus of claim 14, further comprising:

a basketball scoring apparatus; and a scoring indicator selectively responsive to at least one of said target bowling scoring apparatus and said basketball scoring apparatus.

16. The apparatus of claim 15, further comprising a control device having a game select switch for determining which one of said basketball scoring and target bowling scoring apparatuses said scoring indicator is responsive to.

17. The apparatus of claim 15, wherein said scoring indicator is disposed in said back case portion.

18. The apparatus of claim 15, wherein said basketball scoring apparatus comprises:

a paddle mounted proximate to the rim so that said paddle is displaced by a ball passing through the rim; and a switch activated by displacement of said paddle.

19. The apparatus of claim 14, further comprising a removable cover for covering said target bowling scoring apparatus.

20. The apparatus of claim 19, apparatus of claim 5, wherein said cover fits atop at least a portion of said upper surface.

21. The apparatus of claim 14, further comprising:

a basketball return net having an upper end, a lower end, and a body portion therebetween, said upper end being releasably attached to said backboard, said lower end being releasably attached to said coffin portion near said player end of said coffin portion and being disposed lower than said upper end, and said body portion being disposed above said housing and having at least a portion thereof disposed beneath said basketball rim, whereby a basketball dropping through said basketball rim will roll down said basketball return net toward said player end of said coffin portion.

22. The apparatus of claim 14, wherein said backboard support post is coupled to said housing for movement between a first, play position in which said basketball rim is accessible for play and a second, stowed position in which said basketball rim is inaccessible for play.

23. A game apparatus for playing target bowling, basketball, and pinball, comprising:

a housing having a generally horizontal coffin portion having a proximate, player end, a distal, back end, and an upper surface thereon, and a back case portion generally inclined at an angle relative to said upper surface;

a ramp portion disposed between said coffin portion and said back case portion and having one end approximately contiguous with said upper surface;

a pinball apparatus disposed in said coffin portion below said upper surface;

a target bowling scoring apparatus disposed in said back case;

a backboard;

a basketball rim mounted on said backboard; and a backboard support post coupling said backboard to said housing, whereby a ball rolled across said upper surface toward said back case is projected toward said target bowling scoring apparatus by said ramp.

24. The apparatus of claim 23, further comprising:

a pinball scoring apparatus;

a basketball scoring apparatus; and a scoring indicator selectively responsive to at least one of said pinball scoring apparatus, said target bowling scoring apparatus, and said basketball scoring apparatus.

25. The apparatus of claim 24, further comprising a control device having a game select switch for determining which one of said pinball scoring, basketball scoring and target bowling scoring apparatuses said scoring indicator is responsive to, and for selectively causing power to be supplied to said pinball apparatus.

26. The apparatus of claim 24, wherein said scoring indicator is disposed in said back case portion.

27. The apparatus of claim 24, wherein said basketball scoring apparatus comprising:

a paddle mounted proximate to the rim so that said paddle is displaced by a ball passing through the rim; and a switch activated by displacement of said paddle.

28. The apparatus of claim 23, further comprising a removable cover for covering said target bowling scoring apparatus.

29. The apparatus of claim 28, wherein said cover fits atop at least a portion of said upper surface.

30. The apparatus of claim 23, further comprising:

a basketball return net having an upper end, a lower end, and a body portion therebetween, said upper end being releasably attached to said backboard, said lower end being releasably attached to said coffin portion near said player end of said coffin portion and being disposed lower than said upper end, and said body portion being disposed above said housing and having at least a portion thereof disposed beneath said basketball rim, whereby a basketball dropping through said basketball rim will roll down said basketball return net toward said player end of said coffin portion.

31. The apparatus of claim 23, wherein said backboard support post is coupled to said housing for movement between a first, play position in which said basketball rim is accessible for play and a second, stowed position in which said basketball rim is inaccessible for play.

32. A basketball game apparatus, comprising:

a stationary base member;

a basketball backboard and rim assembly; and a support post, said basketball backboard and rim assembly mounted to said support post, and said support post pivotally coupled to said stationary base member for pivotal movement between a first, play position in which said basketball rim is accessible for play and a second, stowed position in which said basketball rim is inaccessible for play.

33. A basketball game apparatus, comprising:

a stationary base member;

a projection provided on said base member, said projection having a slot defined thereon;

a support post mounted on said projection for rotational movement around said projection between a first position and a second position, said support post having an aperture with said projection extending therethrough and a key provided on said aperture for engaging said slot to lock said support post in the first position; and a basketball backboard and rim assembly mounted to said support post.

* * * * *